US005838587A

United States Patent [19]

Maisotsenko et al.

[11] Patent Number: 5,838,587

[45] Date of Patent: Nov. 17, 1998

[54] METHOD OF RESTRICTED SPACE FORMATION FOR WORKING MEDIA MOTION

[75] Inventors: Valeriy S. Maisotsenko, 5628 S. Idalia St., Aurora, Colo. 80015; Vassili A. Arsiri, Odessa, Ukraine

[73] Assignee: Valeriy S. Maisotsenko, Aurora, Colo.

[21] Appl. No.: 637,701

[22] PCT Filed: Dec. 30, 1994

[86] PCT No.: PCT/US94/14890

§ 371 Date: Apr. 30, 1996

§ 102(e) Date: Apr. 30, 1996

[87] PCT Pub. No.: WO95/18419

PCT Pub. Date: Jul. 6, 1995

Related U.S. Application Data

[63] Continuation-in-part of Ser. No. 176,010, Dec. 30, 1993, abandoned.

[51] Int. Cl.[6] ..... F15D 1/02

[52] U.S. Cl. ..... 364/512; 137/2; 137/9

[58] Field of Search ..... 364/512, 578; 137/1–13

[56] References Cited

U.S. PATENT DOCUMENTS

| | | | |
|---|---|---|---|
| 3,733,898 | 5/1973 | Yammoto et al. | 73/198 |
| 4,174,734 | 11/1979 | Bradham, III | 138/39 |
| 4,338,520 | 7/1982 | Stewart | 250/356 |
| 4,534,003 | 8/1985 | Manizione | 364/476 |

(List continued on next page.)

FOREIGN PATENT DOCUMENTS

| | | |
|---|---|---|
| 397822 | 2/1974 | U.S.S.R. . |
| 514970 | 4/1976 | U.S.S.R. . |
| 622993 | 6/1976 | U.S.S.R. . |
| 523196 | 8/1976 | U.S.S.R. . |
| 542027 | 2/1977 | U.S.S.R. . |
| 514970 | 7/1978 | U.S.S.R. . |
| 727936 | 4/1980 | U.S.S.R. . |

(List continued on next page.)

OTHER PUBLICATIONS

Bychkov, "Polarizing Optical Method for Investigation of Flow Through Parts of Pumps" Kishinieu, Shtiinza publishers, pp. 1–130.

Gilpin, "The Morphology of Ice Structure in a Pipe at or Near Transition Numbers," IChE Symposium Series, Heat Transfer–San Diego 1979, No. 189, vol. 75, pp. 89–94.

Gilpin et al., "Wave Formation and Heat Transfer at an Ice–Water Interface in the Presence of a Turbulent Flow," J. Fluid Mech. (1980), vol. 99, part 3, pp. 619–640.

(List continued on next page.)

*Primary Examiner*—Kevin J. Teska
*Assistant Examiner*—A. S. Roberts
*Attorney, Agent, or Firm*—Sheridan Ross P.C.

[57] ABSTRACT

The present invention provides a method of restricted space formation for working media motion that can be used to design flow channels for flow of different working media (liquid or gaseous) in simple as well as complex flow channel configurations, for instance in piping and other conduits, heat exchange devices and other fluid flow devices. In one embodiment, a visual test method is used wherein a special relationship to a characteristic wavelength of a flowing fluid is present with respect to at least one of (1) optically active solid particles suspended in a test medium, (2) a wavelength of light to which flowing test medium is subjected, and (3) the depth of the flow channel in a test model. In another embodiment, a fluid flow structure comprising a micro-scale structure and a large-scale structure can be identified from a visual image of flow of test medium through a test model. Information concerning the fluid structure can be used to select a configuration for a flow channel for use in a fluid flow apparatus. In another aspect, a fluid flow apparatus is provided having a fluid channel with a fluid flow boundary surface shaped to correspond to a shape of a fluid flow micro-scale and/or large-scale discrete structure of a flowing fluid.

70 Claims, 12 Drawing Sheets

U.S. PATENT DOCUMENTS

| | | | |
|---|---|---|---|
| 4,660,587 | 4/1987 | Rizzie | 137/8 |
| 4,735,224 | 4/1988 | Pluviose | 137/1 |
| 4,865,271 | 9/1989 | Savill | 244/130 |
| 5,074,324 | 12/1991 | Ng | 137/13 |
| 5,255,205 | 10/1993 | Wurm et al. | 264/510 |
| 5,275,486 | 1/1994 | Fissenko | 366/177 |
| 5,338,113 | 8/1994 | Fissenko | 366/177 |
| 5,377,129 | 12/1994 | Molvig et al. | 364/378 |

FOREIGN PATENT DOCUMENTS

| | | |
|---|---|---|
| 737662 | 6/1980 | U.S.S.R. . |
| 739261 | 6/1980 | U.S.S.R. . |
| 7733127 | 10/1980 | U.S.S.R. . |
| 859484 | 8/1981 | U.S.S.R. . |
| 1071815 | 2/1984 | U.S.S.R. . |
| 1116218 | 9/1984 | U.S.S.R. . |
| 1117410 | 10/1984 | U.S.S.R. . |
| 1229437 | 5/1986 | U.S.S.R. . |
| 1245763 | 7/1986 | U.S.S.R. . |
| 1337604 | 9/1987 | U.S.S.R. . |

OTHER PUBLICATIONS

Mendes et al., "Periodically Converging–Diverging Tubes and Their Turbulent Heat Transfer, Pressure Drop, Fluid Flow, and Enhancement Characteristics," Journal of Heat Transfer (Feb. 1984), vol. 106, pp. 53–63.

Narayanan et al., "Some Studies on Heat Transfer in Diverging–Converging Geometries," Ind. Eng. Chem. Res. (1988), 27, pp. 149–153.

Byshkov, "Polarizing–Optical Method for Investigation of Flow–Through Parts of Pumps," Kishineu, Shtiinza publishers, 1975, pp. 1–121.

Bychkov, "Visualization System For Thin Flows of Imcompressible Fluid," Kishineu, Shtiinza Publishers, 1980, pp. 1–130.

METHOD OF RESTRICTED SPACE FORMATION FOR WORKING MEDIA MOTION

This application is a continuation-in-part of U.S. patent application Ser. No. 08/176,010 filed Dec. 30, 1993 now abandoned.

FIELD OF THE ART

The invention relates to testing of flowing fluids to provide useful information about fluid flow and to design and manufacture of fluid flow devices.

BACKGROUND OF THE INVENTION

One approach that has been used to describe the energy associated with a flowing liquid is to use the Bernoulli equation:

$$e = z + \frac{p}{\rho g} + \frac{v^2}{2g} + h_w, \quad (1)$$

where e—specific flow energy, z+P/ρg—specific potential energy, z—positional energy, p.ρg—pressure energy, ρ—hydrostatic pressure, p—density of the liquid, $V^2/2g$—specific kinetic energy of flow, V—velocity of the liquid, g—acceleration due to gravity, $h_w$—wastes (losses) of energy to overcome resistance to flow.

(See the book "Hydraulics" by Bolshakov V. A., Popov V. N., Kiev Higher School Lead Publishers, 1989, p. 63.)

The Bernoulli equation is based on the principle of conservation of energy in a flowing fluid at a macroscopic level. Part of the energy of the flowing fluid is lost ($h_w$) to overcome resistance to fluid flow. The lost energy is converted from mechanical energy into thermal energy, which is dissipated and thus is lost to the flowing fluid system. The more complex is the geometry of a flow channel the larger is the loss of mechanical energy by conversion to thermal energy, according to traditional thought. Several attempts have, therefore, been made to understand the characteristics of fluid flow in efforts to identify ways to reduce mechanical energy losses to a flowing fluid.

Investigations during the last thirty years in the field of fluid turbulence have indicated a high level of organization (coherence) for fluid flow. References discussing investigations directed toward coherent flow structures include "Direct and Indirect Methods of Experimental Discovery of Turbulent Jets Coherent Structure," by Vlasov E. V., Ginevsky A. S., Karavosov, R. K. in the selection of papers entitled "Mechanics of Turbulent Flows—Moscow," Nauka Publishers, 1980, p. 206–219; Cantwell B. J., "Organized Motion in Turbulent Flow" —Ann. Rev. Fluid Mech, 1981, v13 pp. 457–515; "Mechanics Vortexes and Waves, " A selection of articles edited by Nikolayevsky V. N., Moscow, Mir (Peace) Publishers, 1984 p.6; Tamai. N, Nezu I., Komatsu T., Ohnari H., Ohashi M., Asaeda T., "The Role of Coherent Structures in Turbulent Flow—Doboki rakkay rombunsyu," Proc ISCE 1990, t 42/3, 25–41.

One informative method of investigating fluid flow is visualization of the flowing fluid. Numerous methods have been developed for such visual investigations (see A.M. Trohan, "Development and Investigation of optical Kinematic Methods for Velocity and Turbulence Measurements," Doct. dissertation, Moscow 1969). Also, some visualization methods have been used to provide information for designing flow channels for some fluid flow devices, such as centrifugal pumps, by subjecting an optically active fluid to polarized light in a model made of transparent, optically inactive material. (See Bychkov Yu. M., "Polarizing-optical Method for Investigation of Flow-through Parts of the Pumps," Kishineu, Shtiinza Publishers, 1975).

A visualization method has also been proposed for use in designing a flow channel for turbomachines by subjecting a flowing optically active fluid to polarized light to investigate fluid flow characteristics. A marginal layer of flow is identified, the boundary shape of which is used to define the profile for a flow channel (See USSR Patent No. 514970 dated 6 Jun. 1976).

These known methods for designing flow channels, however, have found only limited applications. A need exists for a method for evaluating the character of a flowing fluid which could provide greater insights into characteristics of a flowing fluid, which could be used to provide better designs for flow channels, and which would have a wider applicability.

SUMMARY OF THE INVENTION

The present invention involves use of the discovery concerning fluid flow, that flowing fluids have a natural tendency to seek to attain a specific flow structure, referred to herein as a discrete flow structure, in particular fluid flow applications. The discrete flow structure represents velocity gradients which have a tendency to develop in a flowing fluid on both a macro-scale and on a micro-scale. The discrete flow structure includes a large-scale structure of alternating higher and lower velocity bands extending into the flowing fluid from the direction of a flow boundary. The discrete flow structure also includes a micro-scale structure of closely spaced lines of alternating high and low velocity fluid flow. Knowledge of these aspects of the discrete flow structure are used according to the present invention to assist in providing fluid flow devices having flow channels that exhibit a low resistance to flow, because the fluid channels have a design that accommodates the natural tendency of a flowing fluid to attain the discrete flow structure.

In one aspect, the present invention provides a method for testing flow of a fluid to provide information about the discrete flow structure. Obtaining such information is useful in evaluating possible flow channel designs to meet the needs of various fluid flow applications. The method involves visualization of a test medium flowing through a fluid chamber of a test model while the flowing test medium is subjected to electromagnetic radiation. A response of the flowing test medium to the electromagnetic radiation may be evaluated to provide information about the discrete flow structure of test medium flowing in the test model.

Typically, a visual image is made of the flowing test medium in which aspects of the discrete flow structure can be identified.

It has been found, with the method of the present invention, that the discrete flow structure of the test medium flowing through the test model is observable when one or more relationships are present relating to a characteristic wavelength that has been found to be exhibited by flowing fluids. At least one, and preferably all, of the following relationships are present during the flow test: (1) the test medium comprises a solid particle of optically active material suspended in a fluid with the size of the solid particles bearing a size relationship to the characteristic wave length; (2) the flowing test medium is subjected to electromagnetic radiation including a wavelength that bears a relationship to the characteristic wavelength; and (3) the fluid chamber of the test model has depth that bears a certain relationship to the characteristic wavelength.

According to the method of the present invention for testing the flow of a fluid, a visual image of a flowing fluid may be obtained showing relatively wide, alternating light and dark bands in the flowing fluid. Light bands represent regions of higher fluid velocity and the dark bands represent regions of lower fluid velocity. These relatively wide, alternating bands of higher and lower velocity constitute the large-scale discrete structure. A visual image may also be obtained to show closely spaced, alternating light and dark lines representing high and low velocity lines of flow, respectively, within the flowing test medium. These closely spaced lines of flow indicate fluid velocity gradients on a small scale and are referred to as the micro-scale discrete structure.

In one embodiment, information obtained concerning the discrete flow structure of the flowing test medium can be used to design a fluid channel configuration for a specific flow application. The fluid channel may incorporate a wall surface that forms a boundary to fluid flow in the flow channel with the wall surface positioned to correspond in location with a large-scale structure high velocity region of fluid flow. In another embodiment, the wall surface of the fluid channel configuration can be contoured to the shape of a micro-scale structure line of flow, and particularly a micro-scale structure line of flow that emanates from a flow boundary and coincides in location with a high velocity region of the large-scale structure. By positioning a fluid flow boundary wall to correspond with a high velocity region of flow, the resistance to fluid flowing in contact with the boundary is significantly reduced. By contouring the boundary to a micro-scale line, the resistance to flow is further reduced because the boundary accommodates the natural flow tendency of the fluid. In one embodiment of the present invention, a flow device can be made having a flow channel with a configuration that could be designed using information from the test method. The apparatus may be used to transport fluids by flow with relatively low losses of energy to flow resistance.

In another aspect of the present invention, a fluid flow apparatus is provided having a flow channel for conducting the flow of a fluid, in which a contoured surface of a wall forms a flow boundary of the flow channel, with the contoured surface being shaped to correspond with the shape of a discrete flow structure of a flowing fluid. The discrete flow structure shape, to which the shape of the contoured surface corresponds, may be determined by performing a test. In the test, a test model is provided having a flow chamber with a shape based on a longitudinal cross section of the flow channel in the fluid flow apparatus. In the test model, however, the portion of the flow chamber relating to the shaped wall surface is replaced with a cavity space so that during a test, the development of a discrete flow structure can be observed in the vicinity of where the shaped wall surface would have been. In one embodiment, the contoured flow boundary surface is positioned to correspond with the location of a high velocity band of a large scale structure. In another embodiment, the contoured surface corresponds in shape to the shape of a micro-scale structure line.

In one embodiment of the present invention, a fluid flow apparatus is provided in the nature of a piping piece having multiple repeating sections. Each repeating section has a first portion having an expanded area available for flow followed by a second portion having a contracted area available for flow, such that the expansions and contractions in the pipe piece correspond with and accommodate the natural tendency of a flowing fluid to form a discrete flow structure in the pipe piece.

The organized structures of fluid flow which have been described by many authors are often referred to as coherent structures, implying coherent development in time of several oscillating and wave processes. Visual analysis of fluid flow in different hydrodynamic situations, according to the test method of the present invention, shows such a multifactor coherentness from interaction of several aspects of fluid flow. Additionally, however, the discrete structure areas exhibiting highly coherent structures which are observable according to the present invention, are followed by an area of deterioration of flow organization where coherence is not observed.

Furthermore, in a flow channel with a configuration designed considering the proposed method of restricted space formation, i.e., taking into account organized discrete structures of flow, wastes of energy $h_w$ to overcome flow resistance are significantly reduced and may be brought to a minimum. One explanation of the discrete flow structure results obtained in testing is based on the concept of a wave nature of flowing fluids. The highly organized structure of the discrete structure of fluid flow indicates the existence of such a wave nature of a flowing fluid, as observed in visual images of flowing fluids obtained by the test method of the present invention, and as further described in the included Experimental Data Annex.

DETAILED DESCRIPTION OF THE INVENTION

Figure 1:
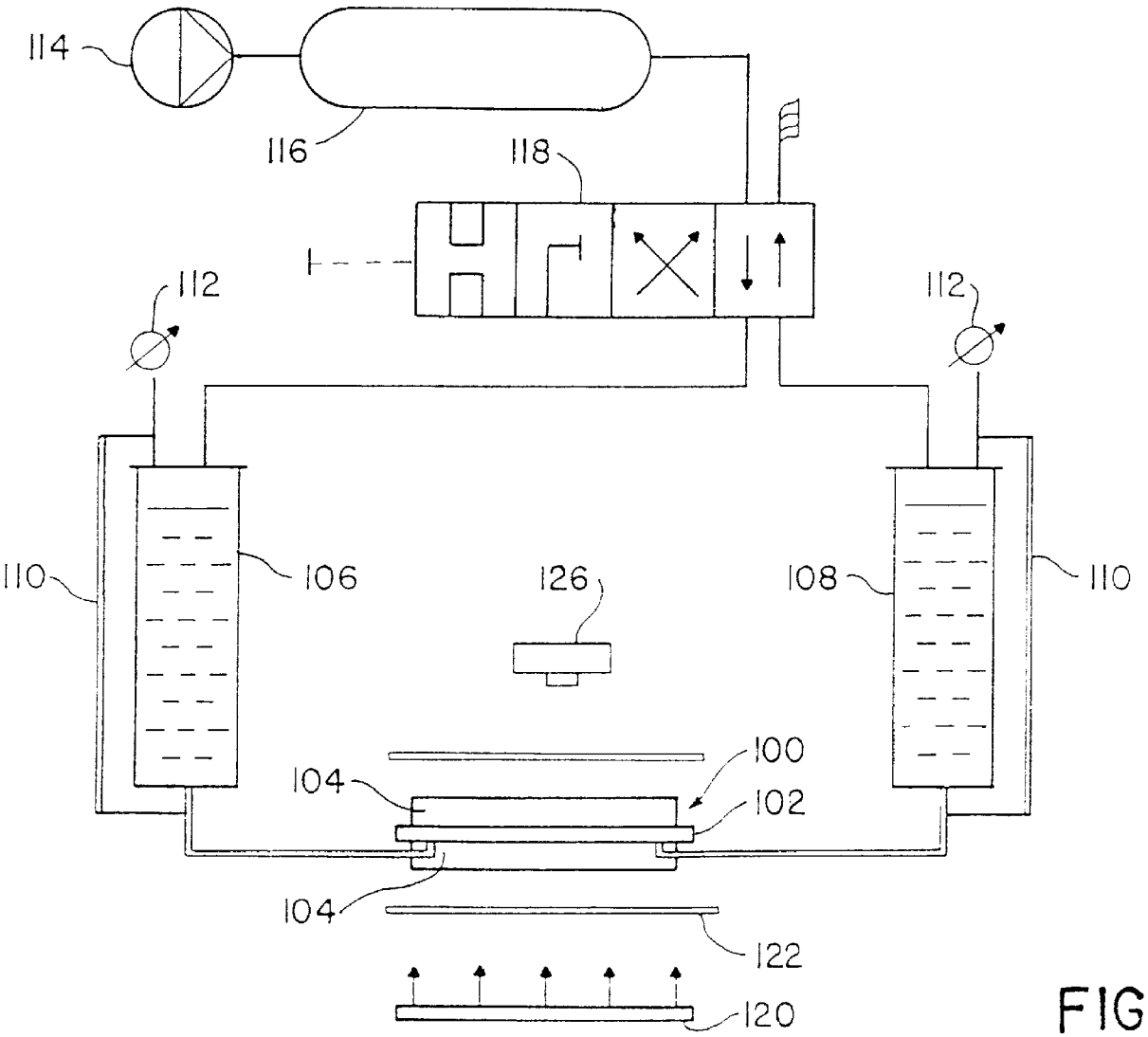
FIG. 1 shows an experimental setup which can be used with one embodiment of a method of the present invention for testing fluid low.

In one aspect, the present invention provides a method of restricted space formation for working media motion, for example, of a flow-through part in which the resistance to flow is reduced and, hence, energetic wastes are also reduced as well. According to the method, a discrete flow structure of a flowing fluid is identified for a particular flow application of interest and a fluid channel configuration is designed having at least one flow boundary with a surface shape corresponding to a shape of the discrete flow structure.

In one embodiment of the present invention, a fluid flow test method is provided using a test model having a fluid chamber through which a fluid may flow for testing purposes. The fluid chamber has a shape designed to model a particular flow application, such as a straight length of pipe, a piping elbow, a valve, a pump cavity, etc. An optically active fluid is flowed through the fluid chamber and is subjected to electromagnetic radiation, which preferably comprises polarized light. A marginal layer, with its inner and outer border lines, will be identified in the fluid chamber along with a hydrodynamic, discrete flow structure of the a fluid flowing in the fluid chamber. A fluid channel configuration for a fluid flow apparatus may then be selected with reference to the marginal layer, a micro-scale discrete fluid flow structure and a large-scale (or macro-scale) discrete fluid flow structure. A fluid flow apparatus may then be made by making a flow channel of the selected configuration in a solid body to provide rigid walls to define the boundaries of the flow channel.

In some cases a flow channel configuration will be selected considering only the large-scale discrete structure and not the micro-scale discrete structure. In other cases the flow channel configuration will be selected considering both the large-scale discrete structure and flow lines of the micro-scale discrete structure, and particularly considering flow lines of the micro-scale discrete structure which adhere to, and which emanate from, the inner border line of the marginal layer of fluid flowing through the fluid chamber of the test model. In still other cases, a flow channel configuration will be selected considering only flow lines of the micro-scale discrete structure. Typically, the flow channel configuration will be selected considering also the natural marginal boundary layer of a main flow region exhibited by the optically active fluid during a test.

According to one embodiment of the test method of the present invention, a transparent, optically transmissive, modeling device is provided which has walls made of optically inactive material. A test channel will be arranged in the modelling device to model a desired real fluid flow object, with structural parameters of the test channel corresponding to structural parameters required in the real object, or that are proportional to the structural requirements of the real object on a modelling scale. A fluid will be pumped through the model under flow conditions which correspond to the real fluid flow object being modelled. To assist in identifying the fluid flow structure of a fluid flowing through the modelling device, the flow will be visually recorded such as by taking photographs of an optically active fluid in the modelling device while being effected by a polarized light.

A discrete fluid flow structure is identified having a micro-scale structure represented by closely spaced flow lines and, where the model geometry permits, a large-scale discrete structure of alternating higher and lower velocity regions, or bands, extending into a main flow space in the modelling device.

To calculate the geometrical profile of the restricted space of a configuration for a flow channel design having a low resistance to flow, and, ideally to provide maximum effectiveness of working media motion in the flow channel, a restricted space configuration for the flow channel will be selected considering the large-scale discrete structure profile and by the shape of a flow line of the micro-scale discrete structure, with the flow line adhering to the inner border line of the marginal layer of the media flowing in the test model. The restricted space profile arranged considering large-scale and micro-scale discrete structures can significantly reduce energetic wastes, and can also reduce rust accumulation, silting, and/or abrasive wear in the flow-through part of the channel (see FIGS. 11 and 12).

Figure 14:
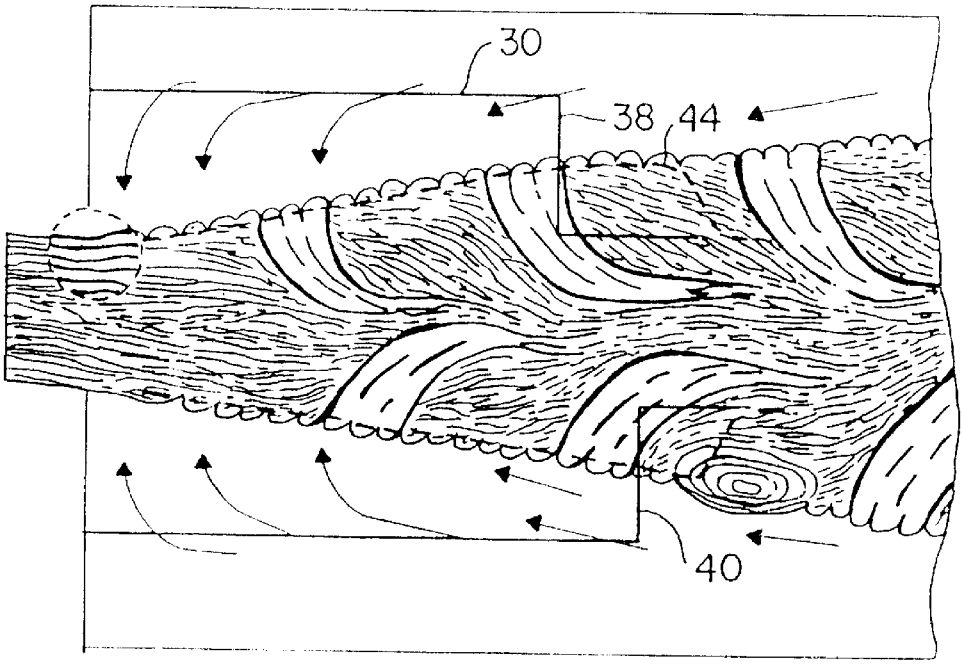
FIG. 14 is an illustration of a flowing test medium showing the discrete flow structure and showing profiles of possible flow channel configurations.
Figure 15:
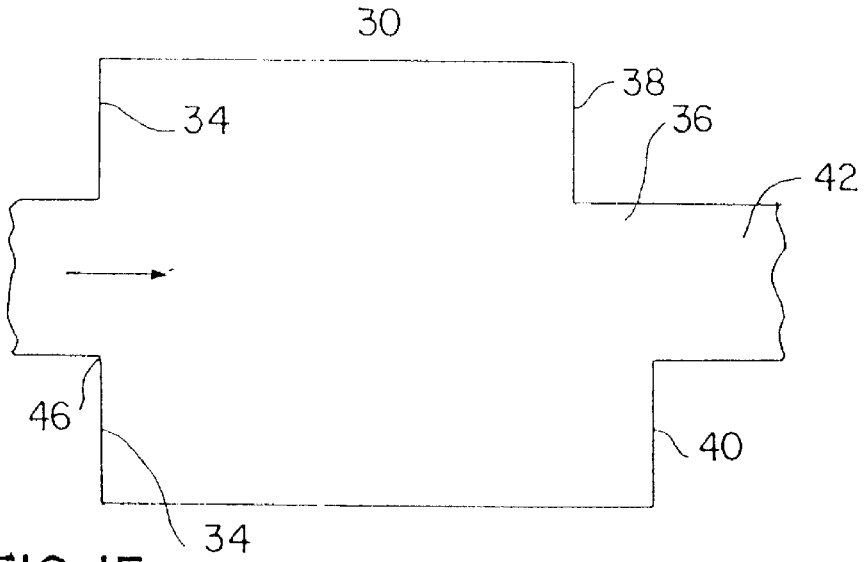
FIG. 15 is a side view of a flow channel configuration having flow area contracting surfaces positioned to correspond with the location of a high velocity region of the large-scale flow structure.

In those cases when there are no technological restrictions with regards to maintaining a clean flow surface or controlling abrasive wear of the flow-through part, then the restricted space configuration for a flow channel could be selected taking into account only the large-scale discrete structure (See FIGS. 14 and 15).

In some cases, when a flow application requires a flow-through part having a very complex geometry it may not practically be possible to obtain a stable, visually observable large-scale discrete structure in the modelling device. In those cases, the profile of the restricted space configuration of a flow channel will be selected considering only flow lines of the micro-scale discrete structure of the investigated flow, and particularly those micro-scale structure lines adhering to the inner border line of the marginal layer in the modelling device.

When desired, the method of the present invention permits a flow channel to be configured to increase, possibly to a maximum possible level, the resistance to working media flow, which can increase the efficiency of various flow applications where sealing is required, such as sealing around a piston to pressurize the flow.

The effectiveness of the proposed restricted space formation method for working media motion has been shown in experiments using both conventional methods and the new method of the present invention developed by the authors (See the Experimental Data Annex within).

In one aspect, the present invention provides a method for testing the flow of a fluid to identify a discrete flow structure for a particular fluid flow application.

Knowledge of the discrete flow structure is useful to assist in designing a fluid flow channel configuration for a fluid flow apparatus to meet the needs of the particular fluid flow application of interest.

FIG. 1 shows a test setup for the test method. The test setup includes a hydraulic system having a test model 100 which has a test plate 102 located between two cover plates 104. The test plate 102 has a pattern through it to define a fluid chamber through which a test medium may be flowed during testing. The pattern of the fluid chamber may be provided by cutting out material from the test plate 102 to provide the desired pattern configuration. The cover plates 104 are rigid and are sealed with the test plate 102 so that the cover plates 104 form boundaries to fluid flow through the fluid chamber in the test plate 102.

The fluid chamber has a depth as measured between the cover plates. The depth can be any convenient depth, but is typically less than about 5 millimeters. The cover plates 104 are made of optically transmissive, optically inactive material so that the flow of test media in the fluid chamber can be visually observed through the cover plates 104 during a test, without altering the test results.

The hydraulic system of the test setup also includes a fluid supply tank 106, or sump, which holds test medium to be delivered to the test model 100 during a flow test.

The hydraulic system also includes a fluid discharge tank 108, or sump, for receiving discharged test media from the test model 100 during a test. Each of the fluid supply tank 106 and the fluid discharge tank 108 are fitted with a level indicator 110 and a pressure indicator 112 so that operation of the hydraulic system during a test can be monitored.

During a test to identify a fluid flow structure, a test medium is supplied from the fluid supply tank 106 and is flowed through the fluid chamber in the test model 100.

The test medium is then discharged into the fluid discharge tank 108. The temperature and pressure of flow in the test model 100 are preferably maintained during the test at substantially constant values which correspond to temperature and pressure conditions anticipated for the actual fluid flow application being modeled.

The test setup, as shown in FIG. 1, also includes a pneumatic system for controlling the pressure and the rate of flow of test medium during a flow test. The pneumatic system comprises a compressor 114 for compressing air and a pressure vessel 116 for receiving and storing compressed air. Compressed air can be fed from the pressure vessel 116 to either the fluid supply tank 106 or the fluid discharge tank 108 through a four-way pneumatic distributor 118.

The test setup, as shown in FIG. 1, also includes an optical system for permitting visual observation and visual recording of test medium flowing in the fluid chamber of the test model 100 during a test to identify a discrete flow structure for test medium flowing in the fluid chamber. The optical system includes a light source 120 and a polaroid polarizer 122 to provide a polarized light, to which the test model 100 is subjected during a flow test. During a flow test, test medium flowing through the fluid chamber of the test model 100 is, therefore, subjected to polarized light. Light coming from the flowing test medium passes through and is processed by a polaroid analyzer 124 to permit a visual recording device 126 to make a permanent visual record of a visual image of the test medium flowing in the fluid chamber of the test model 100. The visual recording device is typically a camera, which is used to take photographs of the flowing test medium. The photograph is useful for helping to identify the flow structure of the flowing test medium in the test model 100 and for evaluating possible designs of a flow channel for use in the desired fluid flow application.

Figure 2:
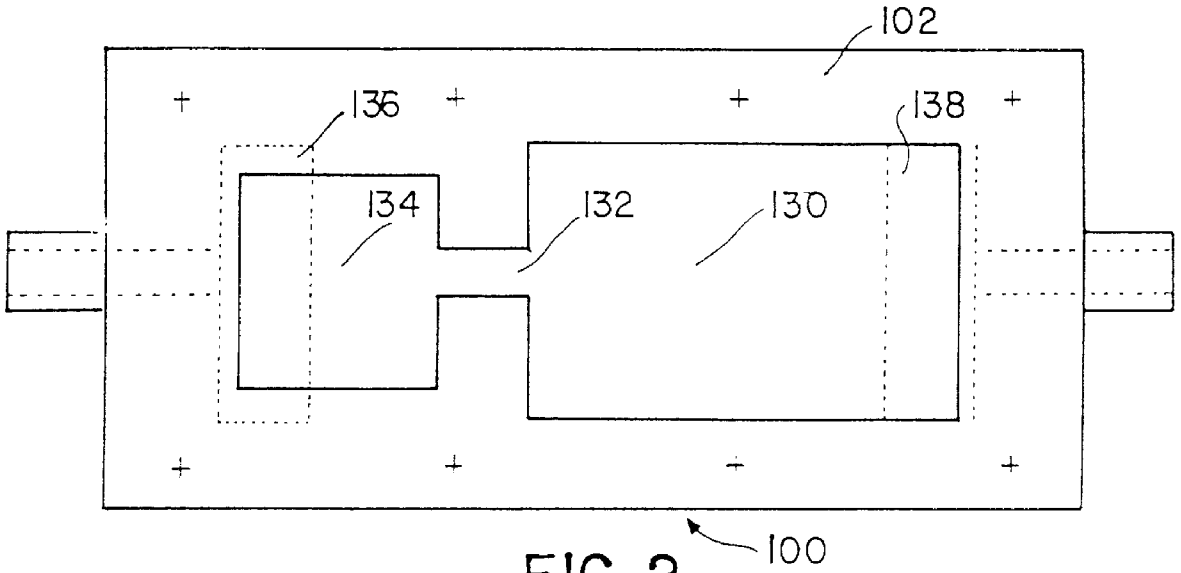
FIG. 2 is a top view of a test model for testing the flow of a fluid.
Figure 3:
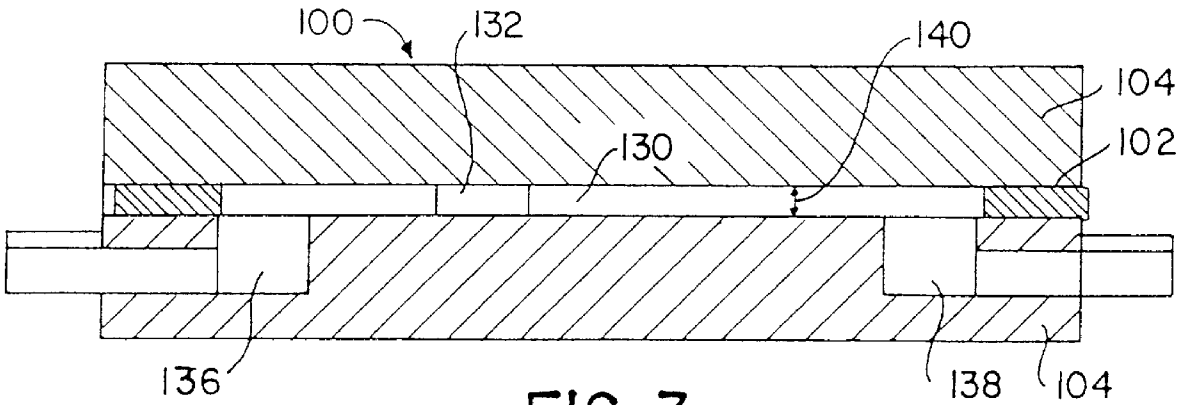
FIG. 3 is a cross sectional view of a test model for testing the flow of a fluid.

The fluid chamber in the test model 100 can have any design that is suitable for modeling the particular fluid flow application of interest. FIGS. 2 and 3 show one embodiment of a test model 100 for modeling flow for substantially straight transportation of fluid, such as in a straight length of pipe. FIG. 2 shows a top view of the test model 100 and FIG. 3 shows a cross-section along a longitudinal axis of the test model 100.

The test model 100, as shown in FIGS. 2 and 3, has a fluid chamber 130 in the test plate 102. The fluid chamber 130 has a depth 140 as measured between the cover plates 104. Patterned in the test plate 102 is an inlet channel 132 to permit test medium to enter the fluid chamber 130 during a flow test. Fluid traveling through the inlet channel 132 comes from a pressure stabilization area 134, which is also patterned in the test plate 102. The test plate 102 is sandwiched between two cover plates 104. One of the cover plates 104 has a fluid inlet collector 136 for receiving flowing test medium by the test model 100 and a fluid outlet collector 138 for discharging flowing test medium from the test model 100.

Other embodiments of the test model 100, having different flow chamber configurations, could be used to model other fluid flow applications. The main consideration in selecting a fluid chamber design for the test model 100 is that a flow inlet port and flow exit port should be located based on structural limitations concerning the particular flow application being modeled. For example, to model a piping elbow, an inlet port and an outlet port should be oriented at a 90° angle to each other, rather than the 180° orientation required for modelling flow in a straight pipe section. The fluid chamber should also contain any structural walls required by the specific fluid flow application. For example, certain structural walls may be required for particular valve or pump applications. Except for structurally required features, as discussed, however, the fluid chamber should have a large cavity space which can be flooded during a flow test to permit a main flow region to develop which is surrounded by a flooded space in the fluid chamber. This permits development of the discrete flow structure in the flowing test medium in the fluid chamber.

As described, the test system shown in FIGS. 1—3 is similar to visualization systems which have been previously used. With the present invention, however, it has been surprisingly found that when one or more of three particular relationships, concerning a wave character of fluid flow, are present during a test, the test method of he present invention permits identification of the discrete flow structure for the test medium flowing through he fluid chamber. This information is useful in assisting in the selection of a configuration for a flow channel to be used in the particular flow application of interest. The inventors are unaware of any previous experimental work by others which has permitted identification of the discrete flow structure which is observable using the test method of the present invention.

To obtain a visual image representative of the discrete flow structure of the test medium in the fluid chamber, it has been found that at least one of the following relationships should be present during the test: (1) the test medium comprises solid particles of optically active material suspended in a fluid, with the solid particles having a size of from about 50% of a characteristic wavelength of fluid flowing through the fluid chamber to about 200% of a characteristic wavelength of fluid flowing through the test chamber; (2) test medium flowing through the fluid chamber is subjected to electromagnetic radiation comprising a frequency of electromagnetic radiation having a wavelength within an order of magnitude of a characteristic wavelength of fluid flowing through the fluid chamber; and (3) the fluid chamber depth is substantially equal to the value calculated by one of the following two equations:

$$d_L=K(\lambda/2)+\lambda/4;$$

and $$d_L=K(\lambda)$$

where:

$d_L$ is the fluid chamber depth;

$\lambda$ is the characteristic wavelength for fluid flowing through the fluid chamber;

K is an integer value determined from the ratio of $2d/\lambda$ by dropping any remainder portion of the ratio; and d is an assumed approximate desired depth for the fluid chamber for ease of testing the actual flow application of interest. The assumed approximate desired depth d is normally selected initially based on the test facilities available, but is typically less than about 5 millimeters. The approximate desired depth d may then be used in one of the two equations to determine the precise depth $d_L$ that should be used in a test.

Preferably, at least two of the three relationships are present in the test system and more preferably all three of the relationships are present. It seems to be particularly important that the relationship be present between solid particles in the test medium and the characteristic wavelength of the fluid to obtain the best visual images of the discrete flow structure.

The incorporation of the test method of the relationships to the characteristic wavelength of a fluid flowing through the fluid chamber has, surprisingly and unexpectedly, been found to produce a visual image of a test medium flowing through the fluid chamber of the test model which reveals significant detail concerning the discrete flow structure of the flowing test medium. The specific relationships result from a finding by the inventors that fluids flowing through a restricted space exhibit a wave character, having a characteristic wavelength. Although the characteristic wavelength appears to vary somewhat depending upon the configuration of the restricted space, the characteristic wavelength has not been found to vary depending upon the type of fluid used.

Therefore, the characteristic wavelength for a fluid flowing through a particular flow channel configuration has been found to be the same for both an aqueous liquid and air. Prior to performing a test according to the present invention, it is, therefore, necessary to determine the characteristic wavelength. Determination of the characteristic wavelength is discussed later.

Typically, the characteristic wavelength will be less than about 1 millimeter, more typically from about 0.4 millimeter to about 0.7 millimeter, even more typically from about 0.45 millimeter to about 0.6 millimeter and still more typically from about 0.5 millimeter to about 0.55 millimeter. For the fluid channel 130 of the test model 100, as shown in FIGS. 2 and 3, the characteristic wavelength has been determined to be about 0.52 millimeter.

In one embodiment, test medium used in the test method comprises solid particles suspended in a fluid, preferably in an aqueous liquid, with the solid particles having a size of from about 60% of the characteristic wavelength to about 120% of the characteristic wavelength, and more preferably of a size from about 20% smaller than the characteristic wavelength to about equal in size to the characteristic wavelength. The particles should be made of optically active material. One preferred material for the solid particles is vanadium pentoxide. Particles made substantially of vanadium pentoxide show good optical activity for use with the test method of the present invention.

In one embodiment, the test method uses electromagnetic radiation, which can be emitted from the light source 120, including a wavelength of from about 50% of the characteristic wavelength to about 200% of the characteristic wavelength, more preferably from about 80% of the characteristic wavelength to about 120% of the characteristic wavelength, and most preferably substantially equal to the characteristic wavelength.

Although the desired wavelength may be mixed with other electromagnetic wavelengths, it is preferred to use substantially monochromatic light of the desired wavelength. Monochromatic light from a laser would be preferred. It should be recognized that for electromagnetic radiation having a wavelength substantially equal to the characteristic wavelength of a fluid flowing in the fluid chamber, a wavelength of light in the infrared region is often required. When obtaining a photograph of the flowing test medium using the visual recording device 126, it should be recognized that special photographic equipment for infrared photography should be used when infrared radiation is used in the light source 120.

In one embodiment, the fluid chamber depth has a value substantially equal to the value calculated by the following equation:

$$d_L=K(\lambda/2)+\lambda/4$$

where $d_L$, K and A are as previously described. It should be recognized that this equation covers two important conditions, when K is an even integer and when K is an odd integer.

When K is an even integer, then $d_L$ will be equal to a multiple of $\lambda$ plus $(1/4)\lambda$. When this condition exists, a resistance to fluid flow through a test chamber configuration should be at a low level because the wave character of the flowing fluid will make a maximum positive contribution to fluid flow. This condition has been found to be particularly good when an object of a test is to obtain a clear visual image of the flow structure over the entire area of the fluid chamber.

When K is an odd integer, then $d_L$ will be substantially equal to a multiple of $\lambda$ plus $(3/4)\lambda$. When this condition exists, resistance to fluid flow through a test chamber configuration should be at a high level because the wave character of the flowing fluid will make a maximum negative contribution to fluid flow. This condition has been found to be particularly good when an object of a test is to obtain a clear visual image of the flow structure in an isolated portion of the fluid chamber, such as in the vicinity of a structural corner or bend.

In another embodiment, the fluid chamber has a value substantially equal to the value calculated by the following equation:

$$d_L=K(\lambda)$$

where $d_L$, K and $\lambda$ are as previously described. When this condition is present, it has been found that turbulence in a flowing fluid can be kept at a very low level and that the condition is, therefore, good for modelling applications in which fluid mixing is to be kept at a minimum.

Visual image records can be made of the fluid flow structure of the flowing test media in the fluid chamber of the test model 100 using any visual recording instrument, such as a camera or a video recorder. When taking photographs of the flowing test medium, an exposure time of from about 0.002 second to about 2 seconds is preferred for obtaining a clear photograph of the micro-scale discrete structure and an exposure time of from about $10^{-6}$ second to about 0.01 second for obtaining a clear photograph of the large-scale discrete structure.

Figure 4:
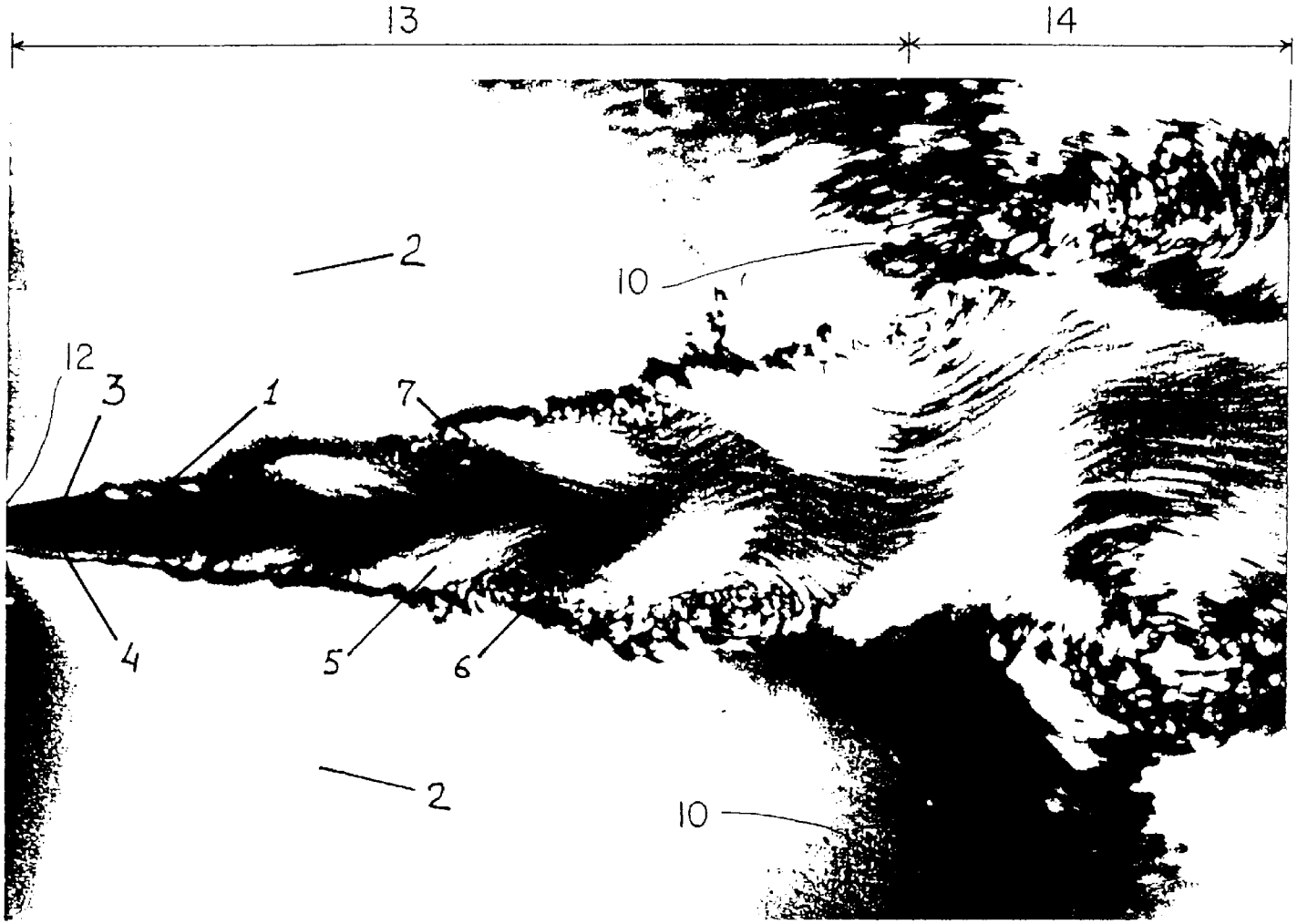
FIG. 4 is a copy of a photograph taken of a flowing test medium in which a discrete flow structure can be identified.

When one or more of the proper relationship are present during the test method of the present invention, then it is possible to obtain a visual image using the visual recording device 126 which reveals a fluid flow structure of test medium flowing through the fluid chamber of the test model 100. FIG. 4 shows a copy of a photograph of test medium flowing in the fluid chamber 130 of the design as shown in FIGS. 2 and 3. The photograph is representative of a test using a fluid chamber depth of approximately 2.47 millimeters (4.75 times a characteristic wavelength of 0.52 millimeters), a test media comprising tap water having suspended therein particles of vanadium pentoxide of a size of approximately 0.5 millimeter, and an ordinary 150 watt incandescent light bulb as a light source.

Referring to FIG. 4, showing the flow of test medium in the fluid chamber 130 during a flow test, a main flow 1 of test medium can be seen entering the fluid chamber from an inlet channel 12. The main flow 1 widens in a jet longitudinally along the fluid chamber. A flooded cavity space 2, which is flooded with test medium, exists in the fluid chamber outside of the main flow 1. The main flow 1 is divided from the flooded space 2 by a marginal boundary layer 7.

As shown in FIG. 4, within the main flow 1 is a discrete flow structure. The discrete flow structure comprises a micro-scale structure comprising closely spaced alternating dark lines 3 and light lines 4. The discrete flow structure also comprises a large-scale structure having alternating light bands 5 and dark bands 6, with the bands extending from the marginal boundary layer 7 in a direction into the main flow 1. In a flow region from the inlet channel 12 to a first shaded area 10, the micro-scale structure and the large-scale structure components both are substantially intact. Beginning with the first shaded area 10, however, the large-scale structure begins to deteriorate. The region of the main flow 1 before the first shaded area 10 is, therefore, called a discrete zone 13. The portion of the main flow 1 following the first shaded area 10 is called a semi-discrete zone 14. If the photograph had extended farther along the main flow 1, it would be seen that, at some distance, the large-scale discrete structure completely disappears in a non-discrete zone.

Figure 5:
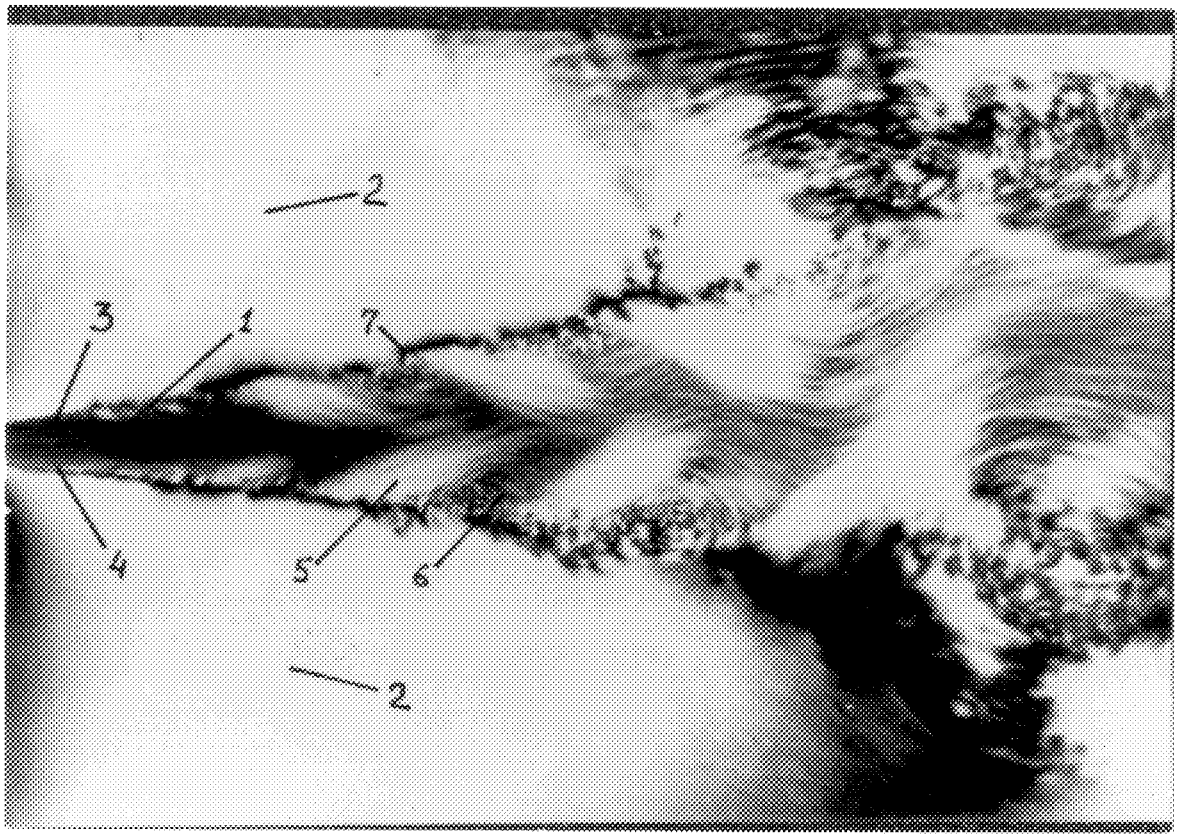
FIG. 5 is an original photograph of a flowing test medium in which a discrete flow structure can be identified.

FIG. 5 is an original photograph of the photograph copy shown in FIG. 4, and shows in greater detail the discrete flow structure features described with reference to FIG. 4.

Figure 6:
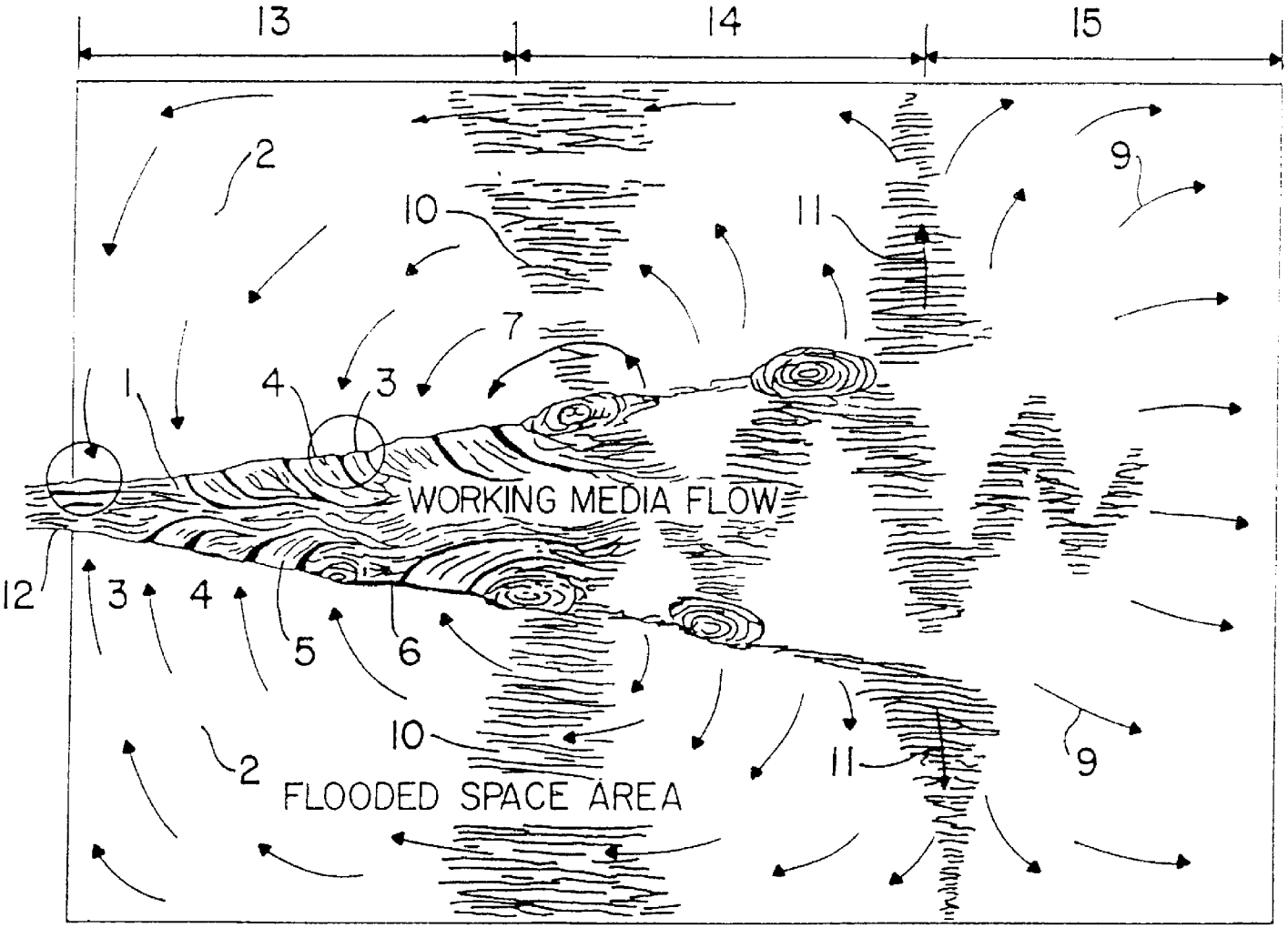
FIG. 6 is an illustration of a flowing test medium showing details of a discrete flow structure.

FIG. 6 shows an illustration of the fluid flow structure of the flowing test media as shown in FIGS. 4 and 5. In addition to the information discussed previously for FIGS. 4 and 5, however, FIG. 6 also shows a second shaded area 11 at which the large-scale discrete structure has completely deteriorated in a non-discrete zone 15. Also shown in FIG. 6 are velocity trajectories 9 for test medium in the flooded cavity space 2.

As shown in FIG. 6, the discrete flow structure exhibited by a fluid flowing in the fluid chamber of the test model comprises two components. First is a micro-scale structure represented by closely spaced dark lines 3 and light lines 4. Second is a large-scale structure of relatively wide, alternating light bands 5 and dark bands 6 which extend in a direction from the marginal boundary layer 7 into the main flow 1 in the fluid chamber in a direction tending towards the longitudinal axis of the main low 1.

The dark lines 3 and the light lines 4 of the micro-scale structure represent lines of the course of fluid flow in the main flow 1. The micro-scale structure lines are found throughout the discrete zone 13, including within the light bands 5 and dark bands 6 of the large-scale structure. Micro-scale lines within the light bands 5 of the large-scale structure emanate from the marginal boundary layer 7 and extend inward into the main flow 1 extending along with the general direction of the light large-scale bands 5.

The closely spaced micro-scale lines show variations of fluid velocity (and also of fluid pressure) over small distances within the flowing test medium. Light micro-scale lines 4 indicate lines of flow at higher velocity (lower pressure) and the dark micro-scale lines 3 indicate lines of flow at a lower velocity (higher pressure). The micro-scale structure is believed to be related to the wave character of a flowing fluid, as previously discussed. The characteristic wavelength of the flowing fluid can be measured by measuring the center-to-center distance between two adjacent dark micro-scale structure lines 3 or two adjacent light micro-scale structure lines 4. In actuality, the lines represent a continuum of varying optical intensity. The characteristic wavelength can be determined with a high degree of accuracy by plotting the light intensity going from a dark micro-scale structure line 3 to a light micro-scale structure line 4.

Figure 7:
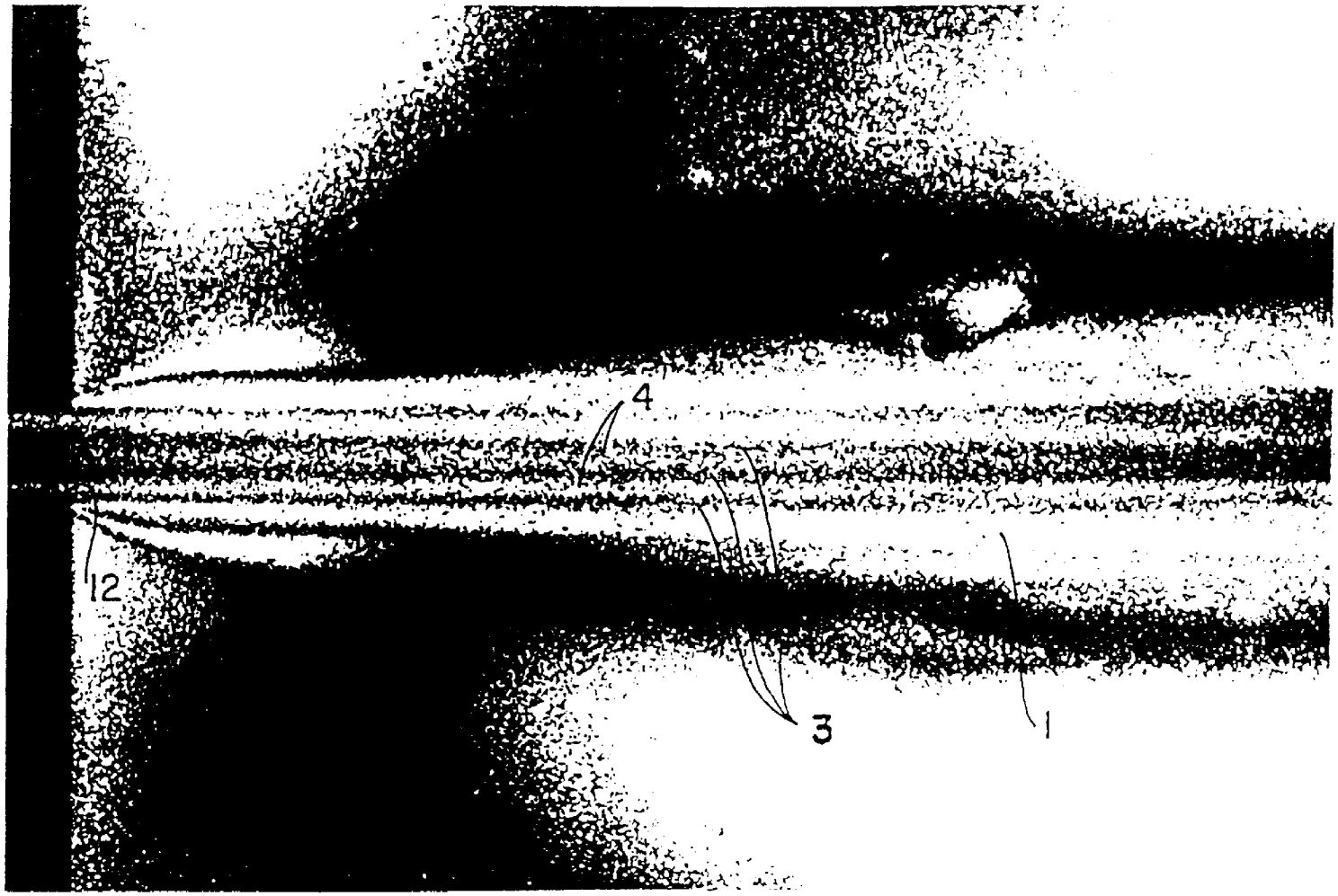
FIG. 7 is a copy of a photograph of a flowing test medium in which micro-scale flow structure lines are shown.

FIG. 7 shows a copy of a close-up photograph of the main flow 1 in a region near the inlet channel 12, in which the alternating dark micro-structure lines 3 and light micro-structure lines 4 are shown in greater detail.

Figure 8:
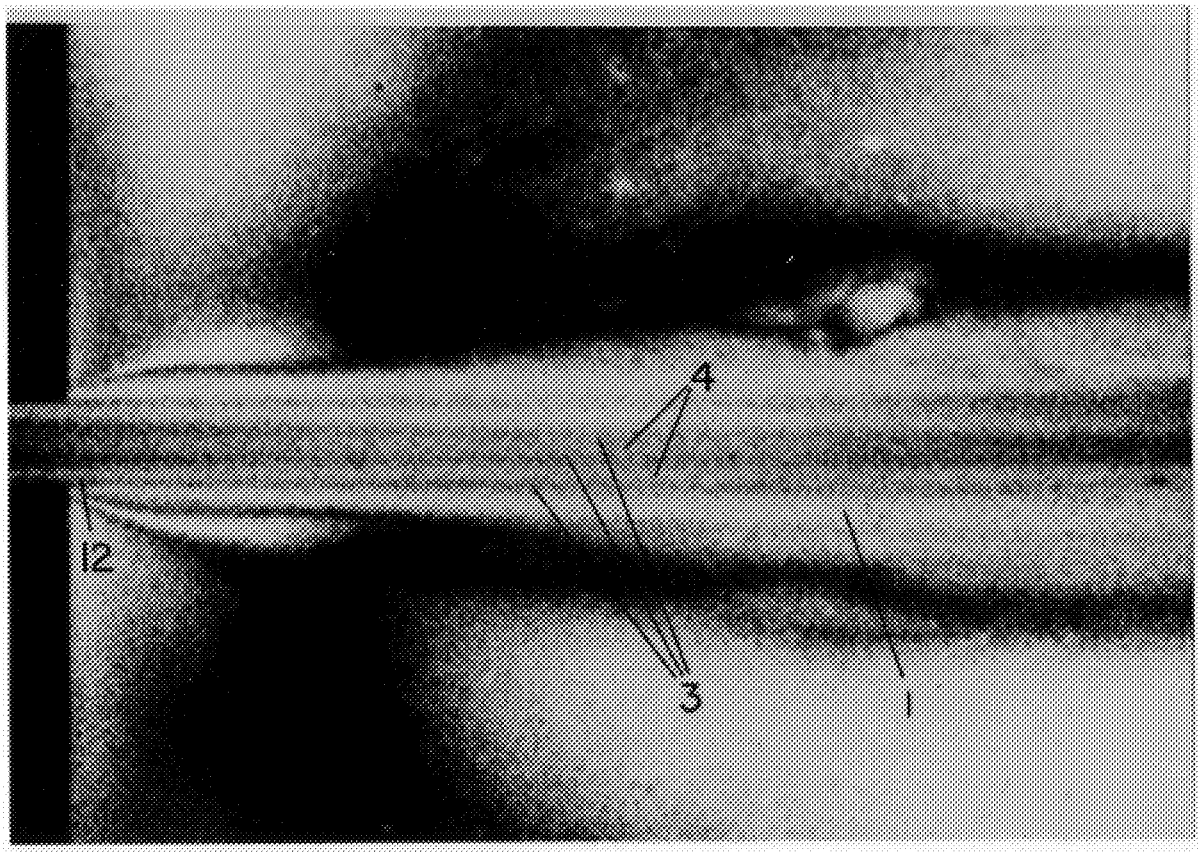
FIG. 8 is an original photograph of a flowing test medium in which micro-scale flow structure lines are shown.

FIG. 8 is an original of the copy of the photograph shown in FIG. 7, in which the micro-scale structure can be more clearly seen. The center-to-center spacing between two adjacent of the dark micro-scale structure lines 3, and between two adjacent of the light micro-scale structure lines 4, is approximately 0.52 millimeter for the micro-scale structure lines shown in FIGS. 7 and 8.

Another way to determine the characteristic wavelength of a fluid flowing in the fluid chamber of a test model is to build a series of different test models. Each test model in the series would have a different depth for the fluid chamber, as measured between the cover plates. A convenient depth, such as 3 millimeters, could be initially selected, and a series of test models having depths both larger and smaller than 3 millimeters, would be prepared for testing. Preferably, the series of test models have fluid chambers with depths that vary in increments of no greater than about 0.1 millimeter. Assuming an adequate number of different test models have been prepared, it has been found that the fluid velocity will vary in the pattern of a wave and will exhibit maximum and minimum fluid velocities in a wave form. A flow test is conducted with each of the test models in the series and a local maximum and a local minimum for fluid velocity through the test models, at constant pressure, is determined. The distance between the local minimum and local maximum is one half of the characteristic wavelength.

Just as the micro-scale structure represents information concerning the relative velocity of flowing fluid, so also does the large-scale structure. Referring to FIGS. 4–6, light large-scale bands 5 indicate areas of higher fluid velocity (and correspondingly, lower pressure) relative to dark large-scale bands 6, which are areas of lower fluid velocity (and correspondingly, higher fluid pressure). Information concerning the location of high velocity large-scale structure regions is very important to designing flow channels having a low resistance to flow.

Figure 9:
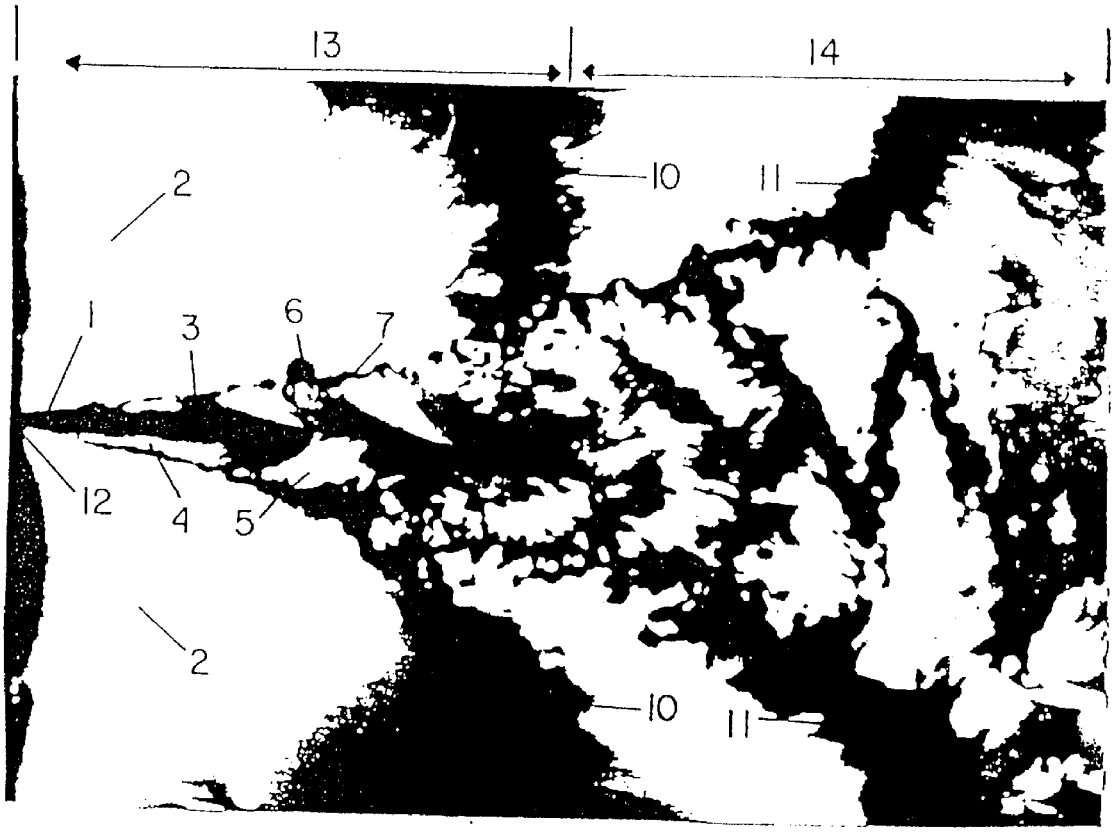
FIG. 9 is a copy of another photograph of a flowing test medium showing a discrete flow structure.

FIG. 9 shows a copy of another photograph of a test medium flowing through a fluid chamber of a test model according to the test method of the present invention. The features, as previously described with reference to FIGS. 4–6, are also shown in FIG. 9.

Once the discrete flow structure for test medium flowing through a fluid chamber of a test model has been identified, information concerning the discrete flow structure can be used to assist in designing a configuration for a flow channel which could be used in the particular fluid flow application of interest.

Figure 10:
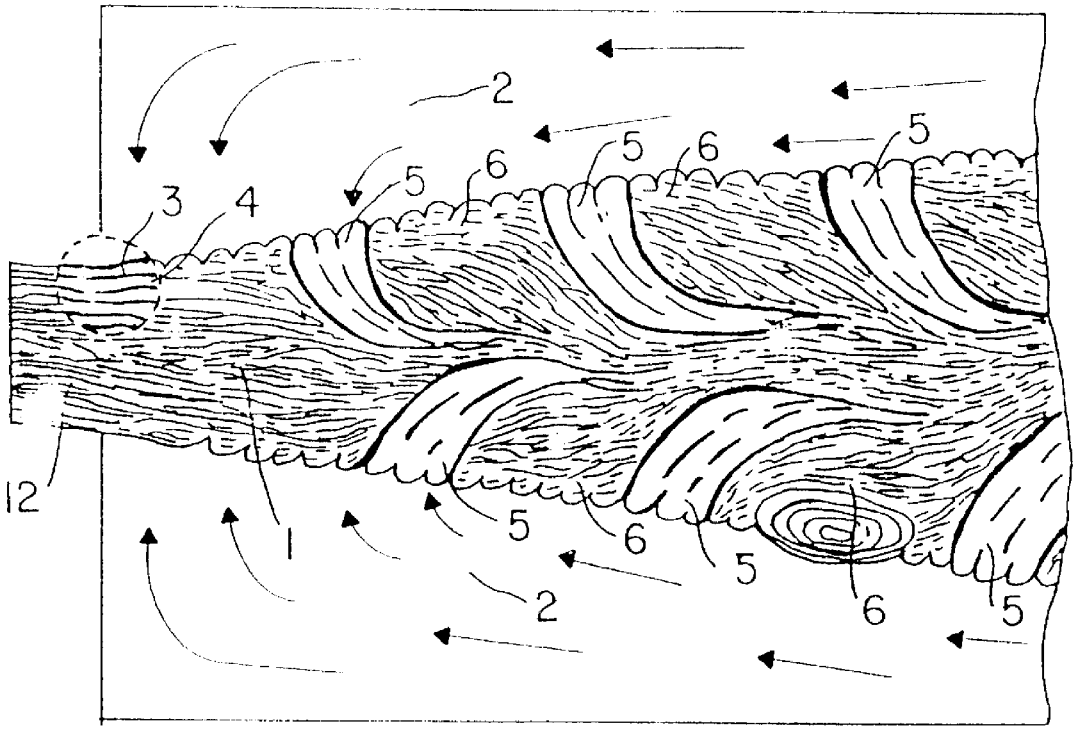
FIG. 10 is a illustration of a flowing test medium showing a discrete flow structure.
Figure 11:
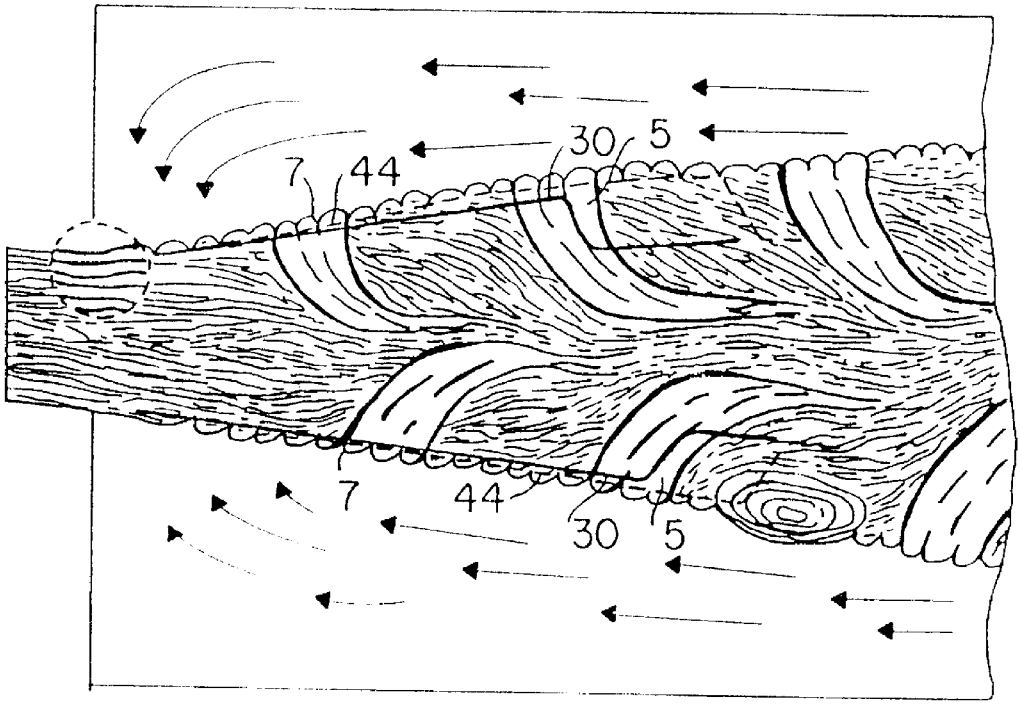
FIG. 11 is an illustration of a flowing test medium showing a discrete flow structure and showing profiles for possible fluid flow channel configurations.

FIG. 10 shows a drawing of the discrete structure zone of the main flow 1 in the test model 100 having the fluid chamber 130, as previously described with reference to FIGS. 1–3. FIG. 11 shows the same discrete flow structure as shown in FIG. 10, except that a proposed profile 30 for a proposed configuration of a flow channel is shown by the overlay of solid lines of the proposed profile 30 on the discrete flow structure. The proposed profile 30 is shown alone without the discrete flow structure, in FIG. 12.

Figure 12:
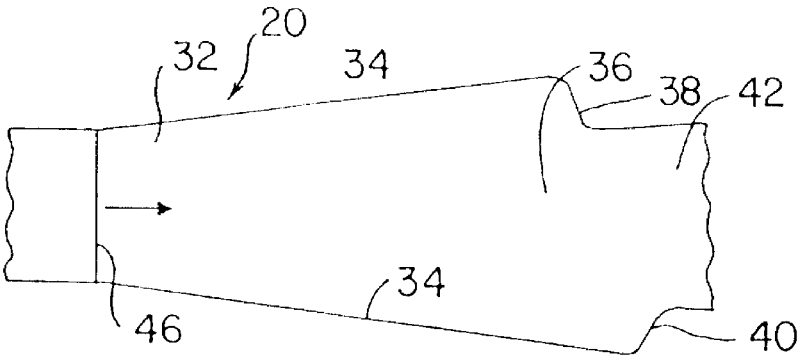
FIG. 12 is a side view of a flow channel configuration having a shape to accommodate a discrete flow structure.

The proposed profile 30 has a flow area expanding, or increasing, portion 32 with expansion boundaries 34 that follow the marginal boundary layer 7, so as not to interfere with free expansion of the jet of the main flow 1, which would add to flow resistance. The proposed profile 30 also has a flow area contracting, or reducing, portion 36 having a first boundary 38 and a second boundary 40 which reduce the area available for flow in the flow channel configuration. It should be noted that the first boundary 38 and the second boundary 40 are positioned to correspond in location to light large-scale structure bands 5, as shown in FIG. 11. Also, the shapes of the first boundary 38 and the second boundary 40 are substantially contoured to the shapes of micro-scale structure lines, within the light large-scale structure bands 5, that extend in a direction from the marginal boundary layer 7 inward into the main flow 1. In a three dimensional flow channel having a rounded cross-section, the flow area contracting portion 36 would have a spiralling shape that spirals around the perimeter of the flow channel configuration. A flow channel having a configuration according to the proposed profile 30, would have a much lower resistance to flow than a traditional pipe of substantially constant circular cross section. At the same pressure, a fluid channel configured with the proposed profile 30 should permit 10 to 30 percent more fluid to be transported through the structure than a pipe of uniform, circular cross section having a cross sectional area available for flow equal to the restricted portion 42 of the proposed profile 30, as shown in FIG. 12. This result is counter to a traditional view that expansions and contractions in a flow channel add additional resistance to flow over that experienced in a smooth pipe having a constant area available for flow.

As discussed, a fluid channel having a configuration of the proposed profile 30 would conform with both the large-scale flow structure and the micro-scale flow structure. A flow apparatus may be made using such a flow channel configuration. In such case, fluid flowing through the flow channel of the fluid flow apparatus would naturally exhibit the flow structure as shown in FIG. 11, and would have a wall forming a boundary to flow in the flow channel which would correspond in location with the presence of a high velocity large-scale band of fluid, as represented by a light large-scale structure band. The boundary formed by the wall would also conform in shape to the micro-scale structure lines of flow adjacent to the wall. For a given flow apparatus, the conformance of flow boundaries to a fluid flow structure can be tested by building a test model, as previously described, having a fluid chamber patterned after a cross-sectional shape of the flow channel taken in along a longitudinal axis of the flow channel. In the test model, however, the wall portion of interest would be replaced with a flooded space, similar to that described previously with respect to FIGS. 1–9 so that the freely developing discrete flow structure could be observed in the vicinity of where the wall portion of interest would have been.

Figure 13:
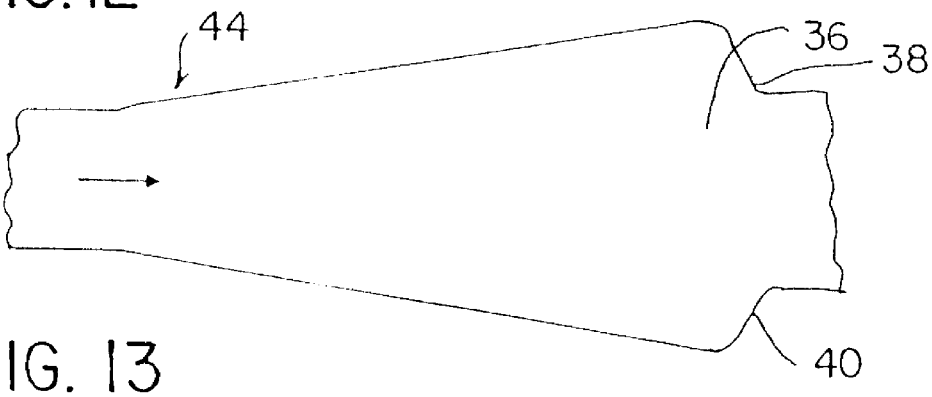
FIG. 13 is a side view of a flow channel configuration for comparison with configurations of the present invention.

For comparison, also shown in FIG. 11 is a profile 44 (shown by dashed lines overlaying the discrete flow structure) for a flow channel having a configuration selected according to USSR Patent No. 514970 dated 4 Jun. 1976. The known profile 44 is also shown in FIG. 13 without the fluid flow structure. As seen in FIG. 13, the known profile also has a flow area contracting portion 36 having a first boundary 38 and a second boundary 40 which reduce the area available for flow. In the known profile 44, however, the first boundary 38 and the second boundary 40 do not correspond in location with a light large-scale structure band 5 and are not contoured to follow a micro-scale structure line. A flow channel using the known profile 44, will, therefore, have a significantly higher resistance to flow than a flow channel using the proposed profile 30, as shown in FIGS. 11 and 12.

The important aspect in relation to the location of the first boundary 38 and the second boundary 40 in the proposed profile 30, are the distances of which the first boundary 38 and the second boundary 40 are located from the beginning 46 of the flow area expanding portion 32. These distances are critical to assure that the first boundary 38 and the second boundary 40 correspond in location with light large-scale structure bands 5.

A flow channel configured according to the proposed profile 30, as shown in FIG. 12, would provide a good flow channel for fluid flow applications where scaling, silting or abrasion of flow surfaces are a problem. Because the boundaries of the proposed profile 30 conform to the natural tendency of a flowing fluid to form the large-scale and the micro-scale structures, the boundaries provide for smooth, uninterrupted flow of fluid adjacent to the boundaries and flow conditions near the boundaries are, therefore, avoided, which would tend to deposit materials suspended in the flowing fluid, or to impinge suspended material on a boundary surface to cause abrasion. Any variation from the ideal profile, however, will cause a disruption of the flow structure, thereby increasing the chances of abrasion of or deposition on a boundary surface.

A fluid channel having the derived configuration could be provided in a flow device by any known manufacturing method, such as by machining a piece of cast metal.

Preferably, however the fluid channel would be made by a technique providing lower cost and greater flexibility, such as an explosive forming technique.

Referring now to FIGS. 14 and 15, another embodiment of a proposed profile 30 is shown which is useful for configuring a flow channel when scaling, silting and abrasion of flow surfaces are not problems. In this embodiment, the first boundary 38 and the second boundary 40 are positioned substantially perpendicular to a longitudinal axis of the proposed profile 30 in the flow area contracting portion. In a three dimensional configuration having a substantially rounded cross sectional area for flow, the flow area reducing portion 36 would involve a substantially spiraling shape around the perimeter of the flow channel. The expansion boundaries 34 of the flow area expanding portion are also positioned substantially perpendicular to the longitudinal axis of the proposed profile 30.

As shown in FIG. 14, the first boundary 38 and the second boundary 40 of the proposed profile 30 are located to coincide with the location of light large-scale flow structure bands. For comparison purposes, the known profile 44 described in USSR Patent No. 514,970, is shown in FIG. 14 (dashed line) and in FIG. 16. Again, the first boundary 38 and the second boundary 40 of the flow area reducing portion 36 of the known profile 44 do not correspond in location with high velocity bands of the large-scale structure. A fluid channel constructed using the known profile 44 would, therefore, have a higher resistance to flow than a fluid channel designed with the proposed profile 30.

The shape of the proposed profile 30, as shown in FIGS. 14 and 15, does not provide as high of a flow efficiency as the proposed profile 30 embodiment shown in FIGS. 11 and 12. The proposed profile 30, as shown in FIGS. 14 and 15, however, has a shape that would be easier to form in a manufacturing operation due to the square angles involved.

In one embodiment, the present invention provides a method for making a fluid flow device having a fluid flow channel through which a fluid may be transported by flow with a relatively low resistance to flow. According to the present invention, a configuration for a flow channel is selected using information about the discrete flow structure from the test method, as previously described.

A fluid flow device is then made having a solid body with the fluid channel through the solid body for conducting a flowing fluid. The fluid flow device has a wall which forms a boundary to flow in the flow channel and which has a fluid contact surface having a contoured portion which is shaped to correspond to a shape of the fluid flow structure, as previously described. In one embodiment, the surface shape corresponds with the location of a high velocity region of a large-scale structure. In another embodiment, the surface shape is contoured to the shape of a micro-structure line of flowing. For maximum flow efficiency, the surface shape should correspond in location with a high velocity large-scale structure band and should also be contoured to the shape of a micro-scale structure line of flow.

In another aspect, the present invention provides a method for transporting a fluid by flow with a relatively low resistance to flow. According to the method, a fluid flow device is provided having a fluid channel configuration corresponding to one, or both, of a high velocity band of a large-scale structure and a flow line of a micro-scale structure. A fluid is then flowed through the fluid channel to transport the fluid in a relatively efficient manner and with relatively low resistance to flow.

In one embodiment of the present invention, a fluid flow device is provided having multiple repeating sections of a flow channel configuration, such as a configuration that may be selected according to the process of the present invention with consideration of the discrete flow structure. For example, multiple flow channel sections with each having a proposed profile as shown in either of FIGS. 12 or 15 could be used, with the end of one of the repeating configuration sections being used as the beginning of the next repeating configuration section.

Figure 17:
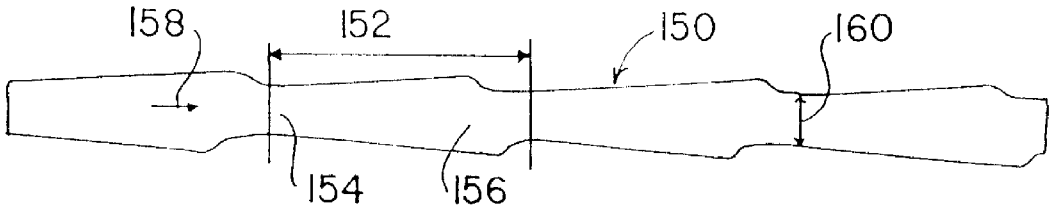
FIG. 17 is a side view of a flow conduit configuration having multiple repeating fluid channel sections.

FIGS. 17–20 show some embodiments of such multiple repeating flow channel configurations. FIG. 17 shows a fluid flow device 150 having multiple repeating flow channel sections 152, configured in a particular way with respect to the flow direction 158, which is the direction in which a fluid would flow through the flow channel. Each repeating flow channel section 152 has a first portion 154 having a smaller average area available for flow and a second portion 156 having a larger average area available for flow. The second portion 156 is shown in FIG. 17 comprises an asymmetrical cross-section for reducing the area available for flow, which is shaped to correspond with both of a high velocity large-scale structure band and a micro-scale structure line, as previously described. The minimum area available for flow 160, preferably has a characteristic dimension d1 which is substantially equal to the value calculated from the following equation:

$$d_1 = n(\lambda) + \lambda/4$$

where:

$d_1$ is the characteristic dimension n is an integer; and $\lambda$ is a characteristic wavelength of a fluid flowing through said repeating conduit section. The characteristic dimension d1 is the diameter of a circular cross-section. For other cross-sectional shapes, the characteristic dimension equals 4R, when R is the hydraulic radius, which is the ratio of the cross-sectional area to the length of the wetted perimeter about the cross-sectional area.

The fluid flow device 150 is preferably a single piece of pipe, which may be used as a pipe length in any piping application, such as in a gas transmission line. In one embodiment, the flow device 150 is suspended in a well to form part of a pipe string through which fluids may be produced from the well. Use in a well, such as in an oil or gas well, permits higher production rates from the well without additional pressure drop.

Figure 18:
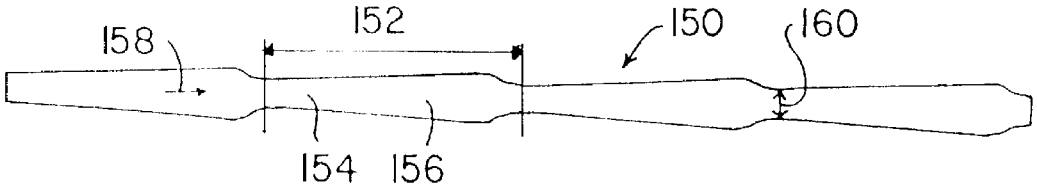
FIG. 18 shows a side view of another flow conduit configuration having multiple repeating flow channel sections.

FIG. 18 shows another embodiment for the fluid flow device 150 in which the flow area reduction in the second portion is accomplished using walls having a symmetrical cross-section. Such walls could be located, for example, to coincide with the beginning of one high velocity large-scale structure band and the end of another high velocity large-scale structure band. The resistance to flow, however, would be expected to be higher than that for the fluid flow device as shown in FIG. 17.

Figure 20:
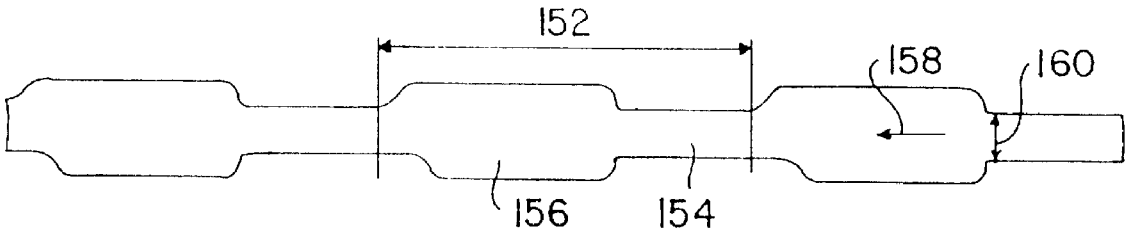
FIG. 20 shows a side view of another flow conduit configuration having multiple repeating flow channel sections.
Figure 19:
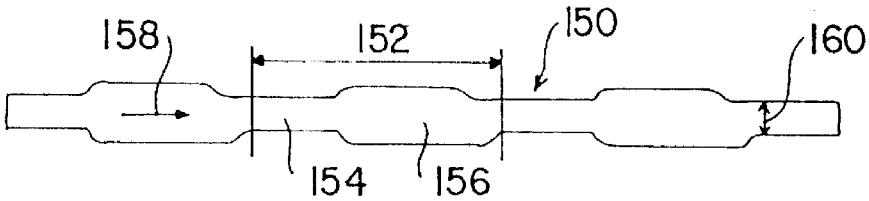
FIG. 19 shows a side view of another flow conduit configuration having multiple repeating fluid channel sections.

FIGS. 19 and 20 show additional embodiments for the fluid flow device 150. The first portion 154 and the second portion 156 configurations have been simplified somewhat for ease of manufacture, thereby somewhat reducing the efficiency of flow through those embodiments. Both of the embodiments of the fluid flow device 150 shown in FIGS. 19 and 20, however, have a flow area reducing structure for the second portion 156 which corresponds with both a high velocity large-scale structure band and a micro-scale line, as previously discussed. The first portion 154, however, is not shaped to the contour of a marginal layer boundary layer.

Some additional experimental data is set out in the following annex with regards to the efficiency of some possible fluid channel configurations.

EXPERIMENTAL

This annex is included to further describe the experimental visualization method of the present invention and flow channels designed using information concerning the discrete flow structure. Any theoretical discussions are included for the purpose of aiding understanding of the present invention, and are not limiting of the scope of the present invention.

For experimental investigation of the proposed method of restricted space formation for working media motion a special experimental setup and experimental procedure were developed.

1. Experimental Unit Description

FIG. 1 presents a general scheme of the experimental unit, as previously discussed with reference to FIGS. 1–3, allowing the following tests to be performed:

hydrodynamic picture visualization under optically active fluid motion in the channels of modelling devices;

hydraulic and aerodynamic tests with various modelling units;

THE EXPERIMENTAL UNIT CONSISTS OF 3 PARTS

1. A hydraulic part incorporating the modelling unit simulating the investigated object.

2. A pneumatic pressure/distributive part.

3. An optical part, incorporating a photorecording installation.

The hydraulic part provides the motion of test medium through the test model presented in FIGS. 2 and 3. Calibrated tanks made of calibrated pipes provide the measurement of the flow rate using a volumetric method (of the averaged fluid flow velocity in the characteristic section of the modelling device).

The pneumatic pressure/distributive part permits variation of flow parameters such as pressure and velocity of fluid in the test model.

The optical part of the experimental unit is used for direct investigation of the motioned working media hydrodynamic structure in the test model using the visualized picture of the optically active fluid in the test model. The optical part also permits a picture to be obtained of flow in the test model, which can later be analyzed.

The test model is the main part of the experimental unit (FIGS. 2 and 3) and consists of a thin sheet of calibrated material (fabric covered with plastic) (hetinox) with a channel cut-out to model the characteristic profile of investigated hydraulic or aerodynamic equipment or application of interest. The test model will be fixed rigidly between two cover plates made of transparent plastic to ensure an air-tight seal and a constant volume through the channel.

FIGS. 2 and 3 show a test model which can be used to trace the motion of working media flow and to visualize the movement of an optically active material in the test medium to directly investigate the hydrodynamic picture of the motioned working media flow.

2. Test Method Description

The optical method for investigating the working media flow in a restricted space, i.e. in hydraulic and aerodynamic channels, is based on subjecting an optically active test medium to polarized light while motioning of the test medium in the test model.

The optically active test medium may be a suspension of 0.04–0.05% weight concentration of vanadium pentoxide. Introduction of soluble salts into tap water of up to the 0.09% by weight will not change the hydrodynamic properties of tap water. The viscosity of the test medium under room temperature will differ from the viscosity of water by 3 to 3.5%. Use of such a test medium permits good correspondence of physical and mechanical properties of flow of the optically active test medium to the properties of fluids in real fluid flow applications.

Briefly the essence of the test method is as follows: ellipsoidal particles of an optically active material, such as vanadium pentoxide, having a size of approximately 500 um are used in the test medium. When moving in the investigated channel the particles will orient in the flow depending on the velocity gradient, and will, thereby, effect the optical density of the test medium during a flow test. When polarized light passes through the optically test medium the effect of double refraction will take place resulting in a phase difference of conventional and polarized light in each point of the flow. By the difference of the intensity of lighting and the lines of movement of the optically active test medium, a hydrodynamic structure for the flowing test medium in the test model may be revealed.

This polarizing-optical method allows a visual image of the hydrodynamic structure to be obtained in the entire spectrum of fluid flow regions, including laminar flow and flow involving a macro and/or micro-scale level of turbulence. A micro-scale discrete structure presented as flow lines as well as a large-scale discrete structure presented as optical bands may be observed in the visual image.

3. Experimental Tests

To get the experimental confirmation of the effectiveness of the method of restricted space formation for working media motion experimental tests were run in the following areas:

1. Direct visual investigations of working media flow motion in the channels of the test model; and
2. Investigation of energy characteristics of working media flow motion in hydraulic and aerodynamic channels.

3.1 METHOD FOR VISUALIZING OF HYDRODYNAMIC STRUCTURE OF WORKING MEDIA MOTION IN THE CHANNELS OF MODELLING DEVICES

To realize the method of the present invention for restricted space formation it is essential to obtain the hydrodynamic structure of working media flow motion. To achieve this, direct visual investigations of the motioned working media were carried out using the experimental setup and test model shown in FIGS. 1–3.

As an example of restricted space formation a profile of a test model channel was used as shown in FIGS. 2 and 3 with a local resistance, i.e. a surprise expansion and a surprise contraction. Such a profile is simple to fabricate, can be easily reproduced when copying, and is, therefore, suitable for use as a test control.

To design the proposed profile of a fluid channel, a hydrodynamic structure of working media motion in the flooded space of the test model was investigated. The dimensions of the test model were selected so as to obtain a complete and high-quality picture of the motioned working media flow development.

The observed interchanging of dark and light areas visually represent the structure of the main flow reflecting kinematic and dynamic structure of the motion working media (see FIGS. 4–9). Dark and light lines, the interchanging of which is concentrated at the length of less than 1 mm, show the presence of a velocity gradient on a small scale within the flow, which led to the name of a micro-scale discrete structure. The interchanging of light and dark wide homogeneous optical stripes, or bands, elongated and bent towards the flow, shows the existence of organized structures of a larger scale in the general development picture of the working media motioned flow. This larger scale development of flow structure is to as large-scale discrete structure.

The organized structures in working media flow are often referred to as coherent structures, implying the idea of simultaneous development of several oscillation and wave processes. The analysis of visual pictures of working media flow in different hydrodynamic situations shows the multifactor interaction of different flow processes. In addition, the flow areas showing a highly coherent structure will be followed by the area of structure deterioration characterized by a more chaotic and less coherent picture. The structural formations, discovered by direct visual investigations or by other hydraulic methods, may be referred to as discrete structures.

Analysis of the working media main flow structures in a main flow region and a flooded space of the test model permits the following presumption: light areas correspond to areas of higher velocity of working media motion and lower pressure and the dark areas correspond to areas of lower velocity and higher pressure.

Three main zones can be distinguished in the working media flow, with reference to FIGS. 4–9:

1. the zone off the inlet channel 12, in the working media main flow 1 up to the first shaded area 10 in the flooded space 2, i.e. a discrete zone 13;
2. the zone in the working media main flow 1 between the first shaded area 10 and the second shaded area ll in the flooded space 2, i.e. a semi-discrete zone 14; and
3. the zone following the second shaded area 11 in the flooded space 2, i.e. a non-discrete zone 15.

To form a restricted space the discrete zone of the working media flow development is considered and its attributes are incorporated into a flow channel design.

With continued reference to FIGS. 4–9, the discrete zone formed when motioning the working media into the flooded space 3 will be characterized by a determined interface structure 7 between the main flow 1 and the flooded space area 2. The interface structure 7 is represented by extending along the main lines at an angle of 11°–13° (with respect to the parallel walls of the inlet channels).

In addition, large-scale interchanging of light bands and dark bands 6 will be observed along the interface 7 with regular periodicity. The bands of similar lightness or darkness, having a discrete character, are located asymmetrically with regards to the axis of the main flow along the upper and the lower interfaces.

Thus direct visual investigations of the hydrodynamic picture of working media motion in the restricted space of the test model have shown wave changes of energetic values in the structure of the motioned working media flow of local flow velocities and pressure values. This indicates the existence of an inner dynamic energy field forming the structure of the motioned working media.

Consequently the inner dynamic energy field of the motioned working media as well as the linear dimensions of the restricted space where the motioning of the media occurs will define the essence and the structure of the flow processes and accordingly the energy consumption when motioning the working media. These factors make the base of the method of the present invention for restricted space formation for working media motion.

3.2 INVESTIGATION OF ENERGETIC CHARACTERISTICS OF WORKING MEDIA MOTION IN THE CHANNELS WITH SHARPLY CHANGING SECTION CONFIGURATION

Tests have been performed concerning the level of energy changes (the main energy parameters of the flows being pressure P and velocity V) under the working media flow motion in flow channels having sharply changing cross-sectional configurations. In such flow channels, the change of energetic parameters will occur at a location, the position of which will correspond to the linear dimension in the characteristic sections. Such centers of energetic objects will be considered as the areas of local resistances. Nowadays such problems are treated as having been sufficiently investigated. There exists, however, significant resistance to flow to permit the measurement of required characteristics when a working media is motioned in restricted spaces, i.e. in various hydraulic and aerodynamic constructions.

The results revealed in this Annex show that construction of the channels with sophisticated configuration is a practical alternative for realizing the proposed method of restricted space formation, i.e. the consideration of the organized nature of the motioned discrete flow structure which offers substantial reduction of the resistance to flow and, accordingly, a reduction of energy wasted during the working media motion in these channels.

3.2.1 ENERGETIC CHARACTERISTICS WITHIN THE RANGE OF LOCAL RESISTANCES DURING THE WORKING MEDIA MOTION IN THE RESTRICTED SPACE

As the main energetic characteristics within the range of local resistances for working media motion in the restricted space a resistance coefficient $\xi$ will be utilized. The resistance coefficient $\xi$ is a coefficient of proportionality between the pressure loss $h_w$ during the working media motion in the restricted space and kinematic component of flow energy $V^2/2g$, namely $$h_w=\xi\cdot V^2/2g. \tag{1}$$

The sum of all the resistances when motioning the working media in a test model brought to one velocity could be presented as the following expression:

$$\Sigma\xi = \xi_{se} + \xi_{sc} + \Sigma C_{fi}\frac{1_i}{R_i} \tag{2}$$

where $\xi_{se}$—resistance coefficient under surprise expansion of the test flow channel;

$\xi_{sc}$—resistance coefficient under surprise contraction of the test flow channel;

$C_{fi}$—specific losses of energy for each segment of the test flow channel having a different area available for flow;

$l_i$—the length of each segment of the test flow channel having a different area available for flow;

$R_i$—hydraulic radius of each length of the test flow channel, $R_i = \frac{h \times b}{2(h+b)}$.

h—height dimension (or depth) of each segment of the test flow channel; and b—base dimension (or width) of each segment of the test flow channel.

Resistance coefficients under surprise extension and surprise contraction of the flow with regards to the velocity in fluid supply and discharge channels are calculated from the relation:

$$\xi_{sc} = \left[1 - \frac{W_1}{W_2}\right]^2, \tag{3}$$

$$\xi_{sc} = 0.5\left[1 - \frac{W_3}{W_2}\right], \tag{4}$$

where $W_1$—inlet channel cross-section area;

$W_2$—test channel cross-section area with maximum area available for flow; $W_3$—discharge channel cross-section area.

The polynomial $$C_{fi}\frac{1i}{R_i}$$

represents energy loss coefficients for each of the supply and discharge channels as well as in the expanded section of the investigated test model.

3.2.2 TEST METHODS AND EXPERIMENTAL DATA ANALYSIS PROCEDURE

Investigation of energetical characteristics of working media flow motion in a restricted space was carried out using a test setup as shown in FIG. 1. In the tests performed by the inventors, the working media was represented by a fluid under normal conditions (ambient temperature of T=20°–25° C. and atmospheric pressure $P_{atm}$=760 mm. mer. col.).

Several test models, with varying test hydraulic channel profiles, were investigated incorporating a number f different local resistances for which the working media motion characteristics may be calculated. The test channel profile shown in FIGS. 2 and 3 has the local resistances of a surprise expansion and surprise contraction. Such a profile is easy to fabricate, and its characteristic linear dimensions are easily reproduced when copying.

In this series of tests the characteristic linear dimensions are as follows:

- $b_1$, $b_3$—widths of the supply and discharge channels, respectively, (mm);
- $b_2$—channel width of the expanded part (mm);
- $l_1$, $l_3$—lengths of the supply and discharge channels, respectively, (mm);
- $l_2$—channel length of the expanded part (mm);
- h—channel height (mm), which is equal for all portions of the test channel used.

Special attention was paid to accuracy and precision with respect to the measurement of characteristic dimensions, with measurements made to a calibrated accuracy of within 0.01 mm. The measurements of the channel widths $b_i$ as well as of the channel lengths $l_i$ were performed by a drawing instrument with a calibrated accuracy of within 0.05 mm. In each separate flow test the following measurements were performed:

- Q—low rate of fluid flowing through the test model;
- t—time during which the pre-set flow rate of fluid flows through the test model;
- $P_p$, $P_d$—pressure in pressure and discharge sumps, respectively, of the test model.

Calculations of main energetical parameters when motioning the fluid in the test model was carried out on the basis of obtained experimental data using the following relationship for calculating the flow rate when motioning the working media through the flow channel of the test model (See Bolshakov V. A., Popov V. N. "Hydraulics". Kiev: Higher School. Lead Publishers, 1989):

$$Q = A \cdot \frac{1}{\sqrt{1+\xi}} \cdot \sqrt{2gH},$$

where

- ξ—resistance coefficient;
- H—full pressure whose action ensures the working media motion through the investigated channel;
- A—area available for flow; and
- g—acceleration due to gravity.

The expression used for calculation of full pressure will be represented as follows:

$$H = \left[\frac{P_p}{\rho g} + \frac{V_p^2}{2g} + z_p\right] - \left[\frac{P_d}{\rho g} + \frac{V_p^2}{2g} + z_d\right],$$

where

- ρ—density of the working media;
- g—acceleration due to gravity;
- $z_p$ and $Z_d$—the height of location of supply and discharge sumps, respectively, of the test model;
- $V_p$ and $V_d$—the velocities in supply and discharge sumps, respectively, of the test model.

When running the tests the test model was positioned with the test channel in the horizontal plane. Therefore the difference of heights between the supply and discharge sumps could be ignored, i.e. $Z_p-Z_d=0$. The dimensions of the sumps are such that the fluid velocity in the sumps are very low, which permits a simplification, of the kinetic components when calculating the value of pressure; i.e. $V^2_p/2g\approx 0$ and $V^2_d 2g\approx 0$. Then the expression for calculation of full pressure value reduces to the following:

$$H=P_p/\rho g-P_d\rho g.$$

Thus, in accordance with the test run conditions, the calculated expression for calculating the flow rate value when motioning the working media through the investigated hydraulic channel could be derived from the following expression:

$$Q = A \cdot \frac{1}{\sqrt{1+\xi}} \cdot \frac{\sqrt{2P_p - P_d}}{g}$$

From this expression, it is possible to calculate the resistance coefficient ξ.

3.2.3. TESTS RESULTS ANALYSIS OF WORKING MEDIA MOTION THROUGH NOZZLE

Table 1 shows the results of experimental investigations of fluid motion in a test model having a fluid chamber designed according to the proposed method with local resistances, namely with a surprise expansion and surprise contraction in the area available for flow.

The experimental investigation was performed using a test model having a fluid chamber having a pattern in the test plate of the proposed profile 30 as shown in FIG. 15.

Figure 16:
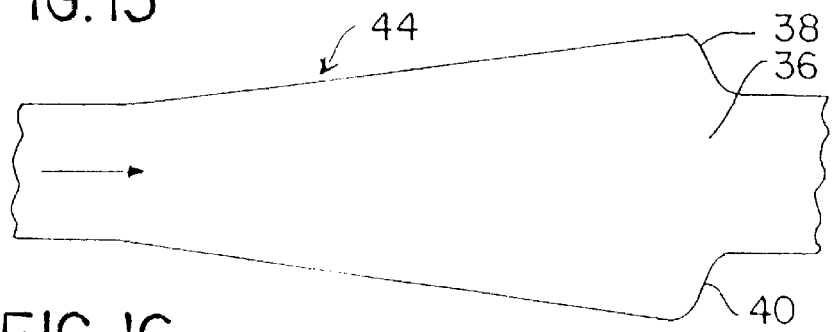
FIG. 16 is a side view of a flow channel configuration shown for comparison.

Comparison information is presented in Table A for a test model having a fluid chamber of the known profile 44, as shown in FIG. 16, according to USSR Patent No. 514970.

The table reveals the obtained values of resistance coefficients $\xi_\Sigma$. of the investigated channels under the fixed values of pressure in the supply sump of the test model ($P_p$=5 meters of water column).

In addition the calculated hydraulic resistance values of the flow-through part of the channel are also specified in the table in a flow-through part developed according to the proposed method of restricted space formation.

TABLE 1

CHANNEL HYDRAULIC RESISTANCES DEVELOPED ON THE BASIS OF THE KNOWN USSR PATENT NO. 514970 AND THE PROPOSED METHOD OF RESTRICTED SPACE FORMATION

| | Q | $\xi_{\Sigma}$ | $\xi_{chan}$ | $\xi_{1.res.}$ | NOTE |
|---|---|---|---|---|---|
| | lit/sec. | — | — | — | |
| Calculated data | 0.10 | 2.725 | 2.148 | 0.577 | According to formulas 2,3,4, |
| Known Method (514970) | 0.092 | 2.72 | — | — | |
| Proposed Method | 0.101 | 2.15 | — | — | |

where

Q—working media flow rate when passing through the investigated channel, lit/sec;

$\xi_{\Sigma}$—total hydraulic resistance of the whole channel;

$\xi_{chan}$—hydraulic resistance of supply and discharge channels, respectively;

$\xi_{1.res.}$—local resistance of surprise expansion and surprise contraction.

The table makes it clear that the proposed method of restricted space formation for working media motion is more effective than the known one. Thus, for instance, when realizing the proposed method (the length of the expanded section having been calculated considering the large-scale discrete structures, length=45 mm) the total hydraulic resistance value of the channel is $\xi_{\Sigma}$=2.15.

Under the same conditions in the channel designed on the basis of the known method of USSR Patent No. 514970 (the length of the expanded section having been calculated without considering large-scale discrete structures, length=37 mm) the total hydraulic resistance value is $\xi_{\Sigma}$=2.72.

At the same time using the calculation method for hydraulic resistance values for the elements of the investigated channel, the following values are obtained:

total hydraulic resistance of the channel $$\xi_{\Sigma}=2.72.$$

total local resistances value $$\xi_{1.res.}=0.577;$$

total channels resistances value $$\xi_{chan.}=2.148.$$

Thus, when using the method of the present invention, it was possible to reduce the resistance value of the investigated channel by 26% relative to the calculated value and relative to that of the channel designed according to USSR Patent No. 514970.

The total resistance value of the whole restricted space, developed according to the method of the present invention for designing the restricted space, amounts to $\xi_{\Sigma}$=2.15. This value could be compared to the calculated supply and discharge channels resistance value $\xi_{chan.}$=2.148 which indicates substantial reduction of resistance due to local resistances of the surprise expansion and surprise contraction.

Various embodiments of the present invention have been described in detail. It should be understood that any feature of any embodiment can be combined in any combination with a feature of any other embodiment. Furthermore, adaptations and modifications to the described embodiments will be apparent to those skilled in the art. Such modifications and adaptations are expressly within the scope of the present invention, as set forth in the following claims.

It is claimed:

1. A method for testing the flow of a fluid, the results of which could be used to assist in selecting a flow channel configuration for a fluid flow apparatus, the method comprising the steps of:

(a) providing a fluid flow test model having an inlet port for receiving a flowing fluid, an outlet port for discharging a flowing fluid, and a fluid chamber located between said inlet port and said outlet port through which a flowing fluid could be directed;

(b) providing a test medium which is capable of flowing through said fluid chamber, wherein said test medium comprises a liquid having a characteristic wavelength when flowing through said fluid chamber;

(c) flowing said test medium through said test model from said inlet port and through said fluid chamber to said outlet port; and (d) subjecting to electromagnetic radiation, during said step of flowing, at least some test medium flowing through said fluid chamber, whereby said test medium exhibits an electromagnetic response representative of a flow characteristic of said test medium, and wherein, to assist in identifying a flow structure of said test medium flowing through said test chamber, at least one of the following relationships with said characteristic wavelength is provided:

(i) said test medium comprises solid particles suspended in a fluid, with said solid particles having a size of from about 50% of said characteristic wavelength to about 200% of said characteristic wavelength;

(ii) said electromagnetic radiation comprises a frequency of electromagnetic radiation having a wavelength within an order of magnitude of said characteristic wavelength; and (iii) said fluid chamber has a depth $d_L$ that is substantially equal to the value calculated by one of the following two equations:

$$d_L=K(\lambda/2)+\lambda/4;$$

and $$d_L=K(\lambda)$$

where:

$d_L$ is the depth of said fluid chamber;

$\lambda$ is the characteristic wavelength;

K is an integer value determined from the ratio of 2 d/$\lambda$ by dropping any remainder portion of the ratio; and d is an assumed approximate desired depth for the fluid chamber.

2. The method of claim 1, wherein:

said test medium comprises solid particles suspended in a fluid, with said solid particles having a size of from about 60% of said characteristic wavelength to about 120% of said characteristic wavelength.

3. The method of claim 1, wherein:

said test medium comprises solid particles suspended in a fluid, with said solid particles having a size of from about 20% smaller than said characteristic wavelength to about equal in size to said characteristic wavelength.

4. The method of claim 1, wherein:

said test medium comprises solid particles having vanadium pentoxide suspended in an aqueous liquid.

5. The method of claim 1, wherein:

said electromagnetic radiation comprises a frequency of electromagnetic radiation having a wavelength of from about 50% of said characteristic wavelength to about 200% of said characteristic wavelength.

6. The method of claim 1, wherein:

said electromagnetic radiation comprises a frequency of electromagnetic radiation having a wavelength of from about 80% of said characteristic wavelength to about 120% of said characteristic wavelength.

7. The method of claim 1, wherein:

said electromagnetic radiation comprises a frequency of electromagnetic radiation having a wavelength substantially equal to said characteristic wavelength.

8. The method of claim 1, wherein:

said characteristic wavelength is from about 0.4 millimeters to about 0.7 millimeters.

9. The method of claim 1, wherein:

said characteristic wavelength is from about 0.45 millimeters to about 0.6 millimeters.

10. The method of claim 1, wherein:

said characteristic wavelength is from about 0.5 millimeters to about 0.55 millimeters.

11. The method of claim 1, wherein:

said test model comprises a substantially flat test plate having a pattern for said fluid chamber in and extending through said test plate; and said test model further comprises two substantially flat cover plates between which said test plate having said fluid chamber is interposed such that each of said cover plates forms a flow boundary of said fluid chamber when fluid is flowing through said fluid chamber, with said fluid chamber having a depth $d_L$ which is the shortest distance, across said fluid chamber, between said cover plates.

12. The method of claim 1, wherein:

said depth $d_L$ has a value that is substantially equal to the value calculated by the following equation:

$$d_L = K(\lambda/2) + \lambda/4.$$

13. The method of claim 1, wherein:

said electromagnetic radiation comprises polarized light.

14. The method of claim 1, wherein:

the method further comprises preparing a visual image of said test medium flowing through said fluid chamber during said step of flowing; and identifying a flow structure which is observable in said visual image.

15. The method of claim 1, wherein:

the method further comprises identifying a flow structure of said test medium flowing through said fluid chamber by evaluating said electromagnetic response; and said flow structure comprises a large-scale flow structure represented, in a visual image of said test medium flowing through said fluid chamber, as alternating light and dark bands extending in a direction from an edge of a main flow region within said fluid chamber toward an interior portion of said main flow region.

16. The method of claim 15, wherein:

the method further comprises selecting a configuration for a flow channel through which flow of a fluid could be directed in a fluid flow apparatus, wherein said flow channel configuration has a flow boundary comprising a first wall surface that is positioned to correspond in location with a light band of said large-scale flow structure.

17. The method of claim 16, wherein:

said wall surface reduces the cross-sectional area available for flow in said flow channel configuration.

18. The method of claim 16, wherein:

the method further comprises identifying a marginal boundary layer for said main flow region; and said configuration for a flow channel is selected such that said flow boundary comprises a second wall surface that is contoured to correspond, in shape and position, with a portion of said marginal boundary layer.

19. The method of claim 16, wherein:

said flow structure comprises a micro-scale flow structure represented, in a visual image of said test medium flowing through said fluid chamber, as closely spaced alternating dark and light lines of flow; and said configuration for a flow channel is selected such that said first wall surface is contoured to correspond in shape with a curved portion of at least one micro-scale structure line.

20. A fluid flow apparatus having a flow channel of the configuration selected according to the method of claim 16.

21. A method for transporting a fluid by flow in the flow apparatus of claim 20, wherein the method comprises the steps of:

providing the fluid flow apparatus of claim 20; and flowing a fluid through said flow channel of said fluid flow apparatus.

22. A method for making a fluid flow apparatus having the flow channel configuration selected in claim 16, the method comprising the steps of:

selecting said flow channel configuration according to the method of claim 16; and manufacturing a fluid flow apparatus having a solid body with a flow channel of said configuration through said solid body.

23. A fluid flow apparatus manufacturable according to the method of claim 22.

24. The method of claim 1, wherein:

the method further comprises identifying a flow structure of said test medium flowing through said fluid chamber by evaluating said electromagnetic response; and said flow structure comprises a micro-scale flow structure represented, in a visual image of said test medium flowing through said fluid chamber, as closely spaced alternating dark and light lines of flow, with a pair of adjacent dark lines being separated by less than about 1 millimeter and a pair of adjacent light lines being separated by less than about 1 millimeter.

25. The method of claim 24, wherein:

the method further comprises selecting a configuration for a flow channel through which flow of a fluid could be directed in a fluid flow apparatus, wherein said flow channel configuration has a flow boundary comprising a first wall surface having a surface shape corresponding in shape with a curved portion of one of said micro-scale structure lines.

26. The method of claim 25, wherein:

said wall surface reduces the cross-sectional area available for flow in said flow channel configuration.

27. The method of claim 25, wherein the method further comprises identifying a marginal boundary layer for a main flow region for test medium flowing through said test chamber, and said configuration for a flow channel is selected such that said flow boundary comprises a second wall surface that is contoured to correspond, in shape and position, with said marginal boundary layer.

28. A fluid flow apparatus having a flow channel of the configuration selected according to the method of claim 25.

29. A method for transporting a fluid by flow in the flow apparatus of claim 28, wherein the method comprises the steps of:

providing the flow apparatus of claim 28; and flowing a fluid through said flow channel of said fluid flow apparatus.

30. A method for making a fluid flow apparatus having the flow channel configuration selected in claim 25, the method comprising the steps of:

selecting a fluid channel configuration according to the method of claim 25; and manufacturing a fluid flow apparatus having a solid body with a fluid channel of said configuration through said solid body.

31. A fluid flow apparatus manufacturable according to the method of claim 30.

32. A fluid flow apparatus having a channel shaped to provide a low resistance to flow of a fluid through the channel, the fluid flow apparatus comprising:

a solid body having a flow channel therethrough for conducting fluid when a fluid is flowing through the fluid flow apparatus;

a wall adjacent to said flow channel and forming a boundary of said flow channel; and a fluid contact surface on said wall and adjacent to said flow channel for contacting a fluid when a fluid is flowing through said flow channel, wherein said fluid contact surface comprises a first contoured portion having a first surface shape that corresponds with a feature of a discrete flow structure of a fluid, when a fluid is flowing through the fluid flow apparatus;

wherein, said feature of said flow structure, to which said first surface shape of said first contoured portion corresponds, is determinable from the following test:

(i) determining a cross-sectional shape of said flow channel that is the shape of a cross-section of said flow channel in a plane parallel to a longitudinal axis of said flow channel, wherein said cross-sectional shape has a boundary formed by a section of said first surface shape of said first contoured portion of said fluid contact surface;

(ii) providing a test model having a test channel cut into a substantially flat test plate which is located between and sealed with two optically transmissive, substantially flat cover plates, such that said test channel may be observed through said cover plates and said cover plates form boundaries to flow of a fluid through said test channel, and wherein said test channel has a test shape that is the same as the shape of said cross-sectional shape of said flow channel except with the portion of the perimeter of said test shape corresponding with said section of said surface shape of said contoured portion being replaced in said test channel with a cavity space which can be flooded with a fluid when a fluid is flowing through said test channel;

(iii) determining a characteristic wavelength of a characteristic wave for a test fluid when flowing through said test channel;

(iv) providing a test medium comprising said test fluid and solid particles comprising vanadium pentoxide suspended in said test fluid, wherein said solid particles have a size in the range of from about 20 percent smaller than said characteristic wavelength to about equal to said characteristic wavelength;

(v) flowing said test medium through said test channel while subjecting test medium flowing in said test channel to polarized light through at least one of said cover plates; and (vi) providing a visual image of said test medium flowing in said test channel, wherein said feature of said flow structure, to which said first surface shape of said contoured portion of said fluid contact surface corresponds, is identifiable in the vicinity of said first cavity space in said visual image.

33. The fluid flow apparatus of claim 32, wherein:

said first surface shape of said first contoured portion of said fluid contact surface is on a portion of said wall which is changing the cross-sectional area available for flow in said fluid channel.

34. The fluid flow apparatus of claim 32, wherein:

said first surface shape of said first contoured portion of said contact surface is on a part of said wall which is reducing the cross-sectional area available for flow in said fluid channel in a direction in which a fluid would flow through said fluid channel.

35. The fluid flow apparatus of claim 32, wherein:

said first surface shape of said first contoured portion of said fluid contact surface is on a part of said wall which abruptly reduces the cross-sectional area available for flow through said fluid channel in a direction in which fluid would flow through said fluid channel.

36. The fluid flow apparatus of claim 32, wherein:

said first surface shape of said first contoured portion of said fluid contact surface comprises a curved surface.

37. The fluid flow apparatus of claim 32, wherein:

said first surface shape of said first contoured portion of said fluid contact surface is curved to be concave away from said fluid channel.

38. The method of claim 32, wherein:

said fluid contact surface comprises a second contoured portion having a second surface shape that corresponds in shape and position with a natural marginal boundary of fluid flow for the fluid flow apparatus;

said shape and position of said marginal boundary is determinable according to said test, wherein;

(i) said test channel has a shape in which a perimeter portion, corresponding to said second surface shape, of said cross-sectional shape of said flow channel is replaced in said test channel with a first cavity space which can be flooded with a fluid when a fluid is flowing through said test channel; and (ii) in said visual image a main flow region is identifiable for said test medium flowing through said test channel, wherein said marginal boundary forms a boundary of said main flow region in the vicinity of said second cavity space.

39. The fluid flow apparatus of claim 32, wherein:

the fluid flow apparatus comprises a pipe having said flow channel as a conduit through said pipe.

40. The fluid flow apparatus of claim 32, wherein:

said feature of said flow structure, to which said first surface shape corresponds, comprises a large-scale flow structure represented by alternating light and dark bands observable in said visual image, with said bands extending in a direction from an edge of test media flow in said test channel toward an interior portion of said test media flow in said test channel, so as to and cross a longitudinal direction of said test channel; and said first surface shape is contoured to correspond with the relative position of a light large-scale flow structure band, with said first surface shape also being on a part of said wall that changes the cross-sectional area available for flow in said fluid channel.

41. The fluid flow apparatus of claim 32, wherein:

said feature shape of said flow structure comprises a micro-scale flow structure represented by alternating, closely spaced light and dark lines of flow; and said surface shape follows a curve corresponding to a curved portion of one of said micro-scale flow lines.

42. The fluid flow apparatus of claim 32, wherein:

said first surface shape of said first contoured portion of said fluid contact surface comprises a curved surface which spirals along a longitudinal direction of said flow channel.

43. The fluid flow apparatus of claim 32, wherein:

said first surface shape of said first contoured portion of said fluid contact surface extends fully around the perimeter of a cross-section of said flow channel taken across a longitudinal direction of said flow channel.

44. The fluid flow apparatus of claim 32, wherein:

said first surface shape is such that a cross-sectional area available for flow in said flow channel, adjoining said first surface shape, is asymmetrical.

45. The fluid flow apparatus of claim 32, wherein:

said first surface shape is such that a cross-sectional area available for flow in said flow channel, adjoining said first surface shape, is symmetrical.

46. The fluid flow apparatus of claim 32, wherein:

said test step of determining said characteristic wavelength for said test fluid when flowing through said test channel comprises evaluating a visual image of a flow structure in a fluid flowing through said test channel of said test model, with said visual image of said flow structure comprising closely spaced, alternating dark and light lines of flow representing a micro-scale flow structure; and determining the center-to-center spacing between two adjacent dark micro-scale structure lines or two adjacent light micro-scale structure lines to determine said characteristic wavelength.

47. The fluid flow apparatus of claim 32, wherein:

said test step of determining said characteristic wavelength for said test fluid when flowing through said test channel comprises providing a series of said test models, each having a slightly different depth of said flow channel between said cover plates; and flowing a fluid through each of said test models to determine a local maximum flow rate and a local minimum flow rate as a function of said depth of said flow channel.

48. The fluid flow apparatus of claim 47, wherein:

said series of test models comprises test models in which the depth of said flow channel is varied in increments of less than about 0.1 millimeters.

49. The fluid flow apparatus of claim 32, wherein:

said characteristic wavelength for said test fluid when flowing through said test channel has a value of from about 0.4 millimeters to about 0.6 millimeters.

50. The fluid flow apparatus of claim 32, wherein:

said polarized light comprises an electromagnetic wave having a wavelength within an order of magnitude of said characteristic wavelength of said test fluid when flowing through said test channel.

51. The fluid flow apparatus of claim 32, wherein:

said test channel of said test model has a depth as measured between said cover plates, with said depth being substantially equal to a value calculated by the following mathematical relationship:

$$d_L = K(\lambda/2) + \lambda/4$$

where:

$d_L$ is the depth of said flow channel;

$\lambda$ is the characteristic wavelength;

K is an integer value determined from the ratio of 2 d/$\lambda$ by dropping any remainder portion of the ratio; and d is an assumed approximate desired depth for the test channel.

52. The fluid flow apparatus of claim 32, wherein:

said test channel of said test model has a depth as measured between said cover plates, with said depth being smaller than about 5 millimeters.

53. The fluid flow apparatus of claim 32, wherein:

said test fluid is an aqueous liquid.

54. A fluid flow apparatus having a fluid flow conduit with a varying cross-sectional area available for flow to provide a low resistance path for fluid flow, the fluid flow apparatus comprising:

a solid body portion;

a conduit through said body portion for conducting the flow of fluid when a fluid is flowing in the fluid flow apparatus, wherein said conduit comprises a plurality of a first conduit section and plurality of a second conduit section, with said first conduit section being regularly spaced in series along said conduit in alternating sequence with regularly spaced second conduit sections;

wherein said first conduit section comprises a cross-sectional area available for flow that increases in a direction along the conduit in which fluid would travel when flowing through said conduit, and said second conduit section comprises a cross-sectional area available for flow that decreases in a direction along said conduit in which fluid would travel when flowing through said conduit;

wherein said first conduit sections each have a smaller average cross-sectional area available for flow than each of said second conduit sections;

wherein each said cross-sectional area available for flow in said first conduit section increases in size more gradually along said conduit than the rate of decrease of each said cross-sectional area available for flow of said second conduit section along said conduit; and wherein each of said first conduit sections is substantially identical to the other of said first conduit sections and each of said second conduit sections is substantially identical to the other of said second conduit sections.

55. The fluid flow apparatus of claim 54, wherein:

the fluid flow apparatus comprises a plurality of a repeating conduit section, with each of said repeating conduit sections comprising one of said first conduit sections and one of said second conduit sections, with said repeating conduit section designed so that a fluid flowing through said repeating conduit section would first flow through said first conduit section and would then flow through said second conduit section;

said first conduit section has an entry port through which a fluid would enter said repeating conduit section and said second conduit section has an exit port through which a fluid would exit said repeating conduit section, wherein said entry port and said exit port have substantially identical cross-sectional shapes and have substantially equal cross-sectional areas available for flow; and wherein, when a fluid is flowing through one of said repeating conduit sections, the resistance to flow of the fluid through the repeating conduit section is lower than if said repeating conduit section had a substantially uniform and continuous cross-sectional area available for flow between said entry port and said exit port that were substantially identical in shape and area to the cross-sectional area of one of said entry port and said exit port.

56. The fluid flow apparatus of claim 55, wherein:

said entry port and said exit port each have a characteristic dimension $d_1$ which is substantially equal to the value obtained from the following equation:

$$d_1=n(\lambda)+\lambda/4$$

where:

$d_1$ is the characteristic dimension n is an integer; and $\lambda$ is a characteristic wavelength of a fluid flowing through said repeating conduit section.

57. The fluid flow apparatus of claim 56, wherein:

said characteristic diameter $d_1$ is equal to 4R, where R is a hydraulic radius, which is the ratio of the cross-sectional area available for flow divided by the length of the wetted perimeter of said cross-sectional area available for flow.

58. The fluid flow apparatus of claim 55, wherein:

said entry port and said exit port are each substantially circular in cross-sectional area.

59. The fluid flow apparatus of claim 54, wherein:

the fluid flow apparatus is a single piece of pipe having said conduit as a fluid flow channel through said piece of pipe.

60. The fluid flow apparatus of claim 59, wherein:

said piece of pipe is suspended inside of a well as part of a string of pipe, such that fluids produced from said well can be transmitted through said piece of pipe.

61. A fluid flow apparatus having a channel shaped to provide a low resistance to flow of a fluid through the channel, the fluid flow apparatus comprising:

a solid body having a flow channel therethrough for conducting fluid when a fluid is flowing through the fluid flow apparatus, wherein a fluid flow structure of a flowing fluid is present in said fluid flow channel when a fluid is flowing through said fluid flow channel, with said fluid flow structure comprising a large-scale structure of alternating bands of higher velocity and lower velocity of flowing fluid, wherein said bands extend, relative to said flow channel, in a direction from a wall of said flow channel inward toward a longitudinal axis of said flow channel;

a wall adjacent to said flow channel and forming a boundary of said flow channel; and a fluid contact surface on said wall and adjacent to said flow channel for contacting a fluid when a fluid is flowing through said flow channel, wherein at least a portion of said fluid contact surface is positioned to coincide with and extend along with one of said bands of said flow structure having a higher velocity, when fluid is flowing in said fluid flow channel, to reduce the resistance to fluid flow through said flow channel.

62. The fluid flow apparatus of claim 61, wherein:

said portion of said fluid contact surface coinciding with and extending along with said higher velocity band of said fluid flow structure, when fluid is flowing through said fluid channel, is on a portion of said wall that changes the cross-sectional area available for flow in said flow channel.

63. The fluid flow apparatus of claim 61, wherein:

said portion of said fluid contact surface coinciding with and extending along with said higher velocity band of said fluid flow structure, when fluid is flowing through said flow channel, has a curved surface shape.

64. The fluid flow apparatus of claim 61, wherein:

said portion of said fluid contact surface coinciding with and extending along with said higher velocity band of said fluid flow structure, when fluid is flowing through said flow channel, extends in a direction that is perpendicular to a longitudinal axis of said flow channel.

65. The fluid flow apparatus of claim 61, wherein:

said fluid flow structure further comprises a micro-scale structure of closely spaced alternating lines of higher and lower velocity flow of said fluid within said higher velocity band, when fluid is flowing through said flow channel; and said portion of said fluid contact surface coinciding with and extending along with said higher velocity band is contoured to follow the shape of one of said lines of flow of said micro-scale structure.

66. A method for transporting a fluid by flow to provide a low resistance to flow of the fluid, the method comprising the steps of:

selecting a fluid to be transported by flow;

selecting temperature and pressure conditions for flow of said fluid;

providing a fluid flow conduit comprising a flow channel through which said fluid may flow, wherein a fluid flow structure is present in said flow channel when said fluid is flowing through said flow channel under said conditions of temperature and pressure, with said fluid flow structure comprising a large-scale structure of alternating bands of higher velocity and lower velocity of flowing fluid, wherein said bands extend, relative to said flow channel, in a direction from a boundary of said flow channel inward toward a longitudinal axis of said flow channel;

wherein said conduit comprises a wall forming a boundary of said flow channel and having a fluid contact surface which contacts fluid when fluid is flowing in said flow channel, and wherein, when said fluid is flowing through said flow channel under said conditions of temperature and pressure, a portion of said fluid contact surface coincides with and extends along with one of said bands of said fluid flow structure having a higher velocity to reduce the resistance to flow of said fluid in said flow channel; and flowing said fluid through said flow channel of said conduit under said conditions of temperature and pressure.

67. The method of claim 66, wherein:

said portion of said fluid contact surface coinciding with and extending along with said higher velocity band of said fluid flow structure, when said fluid is flowing through said fluid channel under said conditions of temperature and pressure, is on a portion of said wall that changes the cross-sectional area available for flow in said flow channel.

68. The method of claim 66, wherein:

said portion of said fluid contact surface coinciding with and extending along with said higher velocity band of said fluid flow structure, when said fluid is flowing through said flow channel under said conditions of temperature and pressure, has a curved surface shape.

69. The method of claim 66, wherein:

said portion of said fluid contact surface coinciding with and extending along with said higher velocity band of said fluid flow structure, when said fluid is flowing through said flow channel under said conditions of temperature and pressure, extends in a direction that is perpendicular to a longitudinal axis of said flow channel.

70. The method of claim 66, wherein:

said fluid flow structure further comprises a micro-scale structure of closely spaced alternating lines of higher and lower velocity flow of said fluid within said higher velocity band, when said fluid is flowing through said flow channel under said conditions of temperature and pressure; and said portion of said fluid contact surface coinciding with and extending along with said higher velocity band is contoured to follow the shape of one of said lines of flow of said micro-scale structure.

* * * * *